US008662138B2

(12) United States Patent
Komatsu et al.

(10) Patent No.: US 8,662,138 B2
(45) Date of Patent: Mar. 4, 2014

(54) SHEET GUIDE OF SHEET SHUTTER

(75) Inventors: Akio Komatsu, Shimane (JP); Hitoyuki Adachi, Shimane (JP); Yoshiaki Horie, Shimane (JP); Takeshi Fujii, Shimane (JP)

(73) Assignee: Komatsu Electric Industry Co., Ltd., Shimane (JP)

( * ) Notice: Subject to any disclaimer, the term of this patent is extended or adjusted under 35 U.S.C. 154(b) by 442 days.

(21) Appl. No.: 12/939,339

(22) Filed: Nov. 4, 2010

(65) Prior Publication Data

US 2011/0108214 A1 May 12, 2011

(30) Foreign Application Priority Data

Nov. 6, 2009 (JP) ..... 2009-255454
Mar. 18, 2010 (JP) ..... 2010-062026

(51) Int. Cl.
*E06B 9/17* (2006.01)

(52) U.S. Cl.
USPC ..... 160/272; 160/273.1; 160/194

(58) Field of Classification Search
USPC ..... 160/273.1, 272, 274, 267.1, 266, 268.1
See application file for complete search history.

(56) References Cited

U.S. PATENT DOCUMENTS 1,694,314 A * 12/1928 Dixson ..... 160/273.1
1,779,646 A * 10/1930 Traut ..... 160/271
1,786,054 A * 12/1930 Dixson ..... 160/273.1
RE18,716 E * 1/1933 Dixson ..... 160/272
4,884,617 A * 12/1989 Coenraets ..... 160/271
5,526,865 A * 6/1996 Coenraets ..... 160/272
6,035,918 A * 3/2000 Kraeutler ..... 160/84.06
6,637,160 B2 * 10/2003 Brooks ..... 52/66
6,942,003 B2 * 9/2005 Thompson ..... 160/268.1
7,036,549 B2 * 5/2006 Coenraets ..... 160/271
7,389,807 B2 * 6/2008 Nagare et al. ..... 160/273.1
7,416,014 B2 * 8/2008 Coenraets ..... 160/273.1
7,516,770 B2 * 4/2009 Jerry ..... 160/267.1
8,291,960 B2 * 10/2012 Bowman ..... 160/267.1
2011/0100570 A1 * 5/2011 Licciardi Di Stefano . 160/368.1
2011/0108214 A1 * 5/2011 Komatsu et al. ..... 160/272
2012/0255683 A1 * 10/2012 Komatsu et al. ..... 160/84.04

FOREIGN PATENT DOCUMENTS

JP 2004-293173 A 10/2004

* cited by examiner

*Primary Examiner* — Blair M. Johnson
(74) *Attorney, Agent, or Firm* — Cheng Law Group, PLLC

(57) ABSTRACT

The present invention is to facilitate the attachment and maintenance work of left and right sheet guides of a shutter and to facilitate the return of the disengaged sheet. A sheet guide of a sheet shutter according to the present invention is a mechanism configured such that a sheet 2 is lifted and lowered by being wound and unwound around a sheet drum 5 supported between left and right support posts 3 and 3 according to the rotation of the sheet drum 5, and such that both the left and right ends of the sheet 2 are lifted and lowered by being guided by sheet guide sections 11 and 11 respectively installed in the support posts 3 and 3. The sheet guide section 11 is configured by an outer rail 14 having a U-shaped cross section which is provided with a pair of front and rear side walls 14*a* and is opened toward the inner side in the horizontal cross section of the left and right support posts 3, and an inner rail 16 accommodated and detachably attached in the outer rail 14 along the inner surface of the outer rail 14. An inward-facing engagement guide 21 configured to vertically slidably and engagingly accommodate each of guide projections 10 respectively attached to both ends of the sheet 2 is provided in the inner rail 16.

9 Claims, 16 Drawing Sheets

SHEET GUIDE OF SHEET SHUTTER

BACKGROUND OF THE INVENTION

1. Field of the Invention

The present invention relates to a sheet guide of a sheet shutter which can be installed in an entrance and a partition portion of a building, such as a factory and a warehouse.

2. Description of the Related Art

Conventionally, a sheet shutter is widely known which is installed in an entrance and a partition portion of a building such as a factory or a warehouse, and in which a sheet provided to be able to be wound and unwound around a sheet drum is lifted and lowered along support posts provided on both sides of the sheet. Further, a sheet shutter is known in which each of guide projections attached to both ends of the sheet is vertically slidably and engagingly accommodated in each of sheet guide sections provided along left and right support posts (see, for example, Japanese Patent Laid-Open No. 2004-293173).

In the sheet guide of the sheet shutter, an engagement guide consisting of an inward-facing coming-off prevention guide for preventing the coming-off of the guide projection, and a guide wall is integrally provided in each of the left and right support posts. Further, when the sheet is strongly pushed by a strong wind, collision with a passing body, or the like, the guide projection is allowed to come off from the engagement guide counter to the holding force of the engagement guide for preventing the coming-off of the guide projection, so that sheet can be detached from the support post. Further, a sheet return guide, which enables the sheet detached from the support post to be returned in the sheet guide section at the time when the sheet is lifted, is provided in the sheet case which is provided in an upper portion of the support posts so as to accommodate the sheet drum.

SUMMARY OF THE INVENTION

In the sheet shutter described in Japanese Patent Laid-Open No. 2004-293173, opening and closing operations are performed in the state where the coming-off of the guide projection and the detachment of the sheet are prevented by the engagement guide provided in each of the left and right support posts. On the other hand, when the sheet receives a strong wind or is collided with a passing body, the sheet can be detached from the support post by allowing the guide projection to come off from the engagement guide counter to the holding force of the engagement guide. Further, the sheet detached from the support post can be automatically returned to the inside of the sheet guide section by the sheet return guide when the sheet is lifted.

However, the above described sheet shutter has disadvantages as follows. That is, in the sheet guide section, the engagement guide is integrally provided in the support post, and hence the structure of the support post is complicated so as to increase the manufacturing cost. Further, when due to long time use, the guide wall of the engagement guide is deformed in the press-opening direction or the coming-off prevention guide is worn out, the entire support post needs to be exchanged because it is not possible to exchange only the engagement guide. Further, the maintenance work performed by removing the support post from the sheet case is inefficient and increases the cost of the maintenance work. Further, there is such a problem as that, when the sheet return guide is to be exchanged, the exchanging work needs to be performed in the inside of the sheet case and hence it is difficult to perform the maintenance work.

A primary object of the present invention as will be described below is that, when the sheet is pressed by receiving a strong wind and thereby the guide projection is about to come off from the engagement guide, the engagement guide formed in an inner rail prevents the coming-off of the guide projection so as to enable the opening and closing operation of the sheet to be smoothly performed while preventing the detachment of the sheet due to the wind.

One of the objects of the present invention is also that, in the case where the inner rail is worn out, the maintenance work is simplified by exchanging only the inner rail without exchanging the support post.

Further, a second object of the present invention is that the inner rail is fitted into an outer rail so as to be slidable in the sheet width direction and is supported by being urged in the outer direction, whereby when the sheet is pressed by receiving a strong wind and thereby the guide projection is about to come off from the engagement guide, the stretched state of the sheet is maintained while the pressing force of the wind is buffered in such a manner that the inner rail is slid and moved in the inner direction counter to the outward urging force to allow the guide projection to be resiliently returned to the original attitude.

A third object of the present invention is that the engagement guide and an inner locking section are integrally formed respectively on the inside and the outside of a partition wall provided in an intermediate portion of the inner rail, whereby the strength of the inner rail is increased, the entire structure of the inner rail is made compact, and the inner rail is fitted to be smoothly slid in the outer rail so that the outward resilient support force is maintained.

A fourth object of the present invention is that the engagement guide is configured by a pair of guide walls respectively having hook-shaped tip sections facing each other, and a constriction section is formed between the base portion of the outside surface of the guide wall and the partition wall, whereby the guide projection is smoothly engaged and guided while the attitude of the engagement guide is properly maintained. Further, the fourth object of the present invention is that, when the sheet receives a pressing load higher than a predetermined level due to a wind pressure, or the like, the load is prevented from being intensively applied to the guide wall, and the guide walls are pressed and mutually separated in the front and rear direction by the constriction section and the partition wall, and the like, whereby the guide projection is disengaged from the engagement guide, and thereby the deformation and damage of the guide wall and the guide projection are prevented.

A fifth object of the present invention is that a sheet return guide is detachably connected to the upper portion of the inner rail supported in the outer rail, whereby the sheet disengaged from the engagement guide of the inner rail is simply returned to engage the engagement guide by the sheet return guide at the time when the sheet is lifted. Further, the fifth object of the present invention is that the sheet return guide is stably supported by the inner rail and the outer rail so as to enable the sheet return guide to be easily attached and detached.

It is also one of the objects of the present invention that, in the sheet guide according to the present invention in which the inner rail is detachably attached in the outer rail, an end of a laterally-directed sheet-stretching-core of a sheet with the core is vertically slidably inserted into the outer rail from which the inner rail is removed, whereby the sheet shutter for lifting and lowering the sheet with the guide projection is also used as the sheet shutter for lifting and lowering the sheet with the core without the need of changing the support post, and the like.

Another object of the present invention is that the inner rail is resiliently slid in the left and right direction in the outer rail whereby the sheet is smoothly lifted and lowered in the state of being sufficiently stretched in the left and right direction. Further, it is also an object of the present invention that a spring seat is resiliently pressed and attached to the inner surface of the seat wall of the outer rail whereby the guide rail is simply assembled by inserting the inner rail between the spring seat and the outer rail.

The objects of the present invention other than the above described objects will become apparent in the detailed description of the present invention.

In order to solve the above described problems, a sheet guide of a sheet shutter according to a first aspect of the present invention includes: a sheet case 4 configured to laterally and rotatably journal therein a sheet drum 5 for winding and unwinding a sheet 2 in the vertical direction; support posts 3 respectively provided to support both the left and right ends of the sheet case 4; and a sheet guide section 11 fixed to each of the support posts 3 so as to guide the up and down movement of the sheet 2, and is featured in that the sheet guide section 11 is configured by an outer rail 14 having a U-shaped cross section which is provided with a pair of front and rear side walls 14*a* and is opened toward the inner side in the left and right direction of the a horizontal cross section of left and right support posts 3, and an inner rail 16 accommodated and detachably attached in the outer rail 14 along the inner surface of the outer rail 14, and in that the inner rail 16 is provided with an engagement guide 21 facing the inner side in the left and right direction and configured to vertically slidably and engagingly accommodate each of guide projections 10 respectively attached to both ends of the sheet 2.

A sheet guide of a sheet shutter according to the second aspect of the present invention is featured in that the hollow inner rail 16 having front and rear side walls 24 is fitted in the outer rail 14 so as to be slidable in the left and right direction of the sheet and is supported by being resiliently pulled toward the outside in the left and right directions.

A sheet guide of a sheet shutter according to a third aspect of the present invention is featured in that an intermediate wall 19 for partitioning the inside and the outside of the inner rail 16 in the left and right direction is formed in the front and rear direction in an intermediate portion of the inner rail 16, in that the engagement guide 21 is formed at a position inside the intermediate wall 19, in that the side walls 24 directed in the left and right direction are respectively provided at outside positions of both the front and rear ends of the intermediate wall 19, in that an inner locking section 22 formed by a predetermined space is formed between the front and rear side walls 24 and 24, and in that a spring 28 for resiliently pulling the guide projection 10 to the outside direction is accommodated in the inner locking section 22.

A sheet guide of a sheet shutter according to a fourth aspect of the present invention is featured in that the engagement guide 21 is configured by a pair of front and rear guide walls 23 and 23 which are respectively provided on the intermediate wall 19 so as to project to the inner side and respectively have mutually inward-facing hook-shaped tip sections for engagingly accommodating the guide projection 10, and in that a concave constricted section 19*a* is formed between the base portion of the outside surface of each of the guide walls 23 and 23, and the intermediate wall 19.

A sheet guide of a sheet shutter according to a fifth aspect of the present invention is featured in that a sheet return guide 17 for, when the sheet 2 is lifted, guiding and returning each end of the sheet 2 disengaged from the engagement guide 21 of the inner rail 16 into the engagement guide 21 is detachably connected to the upper end portion of the inner rail 16.

A sheet guide of a sheet shutter according to a sixth aspect of the present invention is featured in that a plurality of mounting holes 14*e* are provided at a predetermined interval in the vertical direction in a bottom wall 14*c* which is formed between the outside ends of the front and rear side walls 14*a* of the outer rail 14, in that a vertically directed pin groove 24*b* is formed between hook sections 24*a* which are respectively formed at the outside ends of the front and rear side walls 24 of the inner rail 16 so as to face each other, in that the inner rail 16 is attached to the outer rail 14 by respectively inserting a plurality of mounting pins 26 each having a head section 26*b* at the inner side end thereof into the mounting holes 14*e* and the pin groove 24*b*, in that the spring 28 with the mounting pin 26 inserted therein is accommodated in the inner locking section 22 which is the space formed between the side walls 24 and 24 of the inner rail 16, and the inner rail 16 is attached to the outer rail 14 by the spring 28 so as to be resiliently slidable in the left and right direction with respect to the outer rail 14.

A sheet guide of a sheet shutter according to a seventh aspect of the present invention is featured in that a vertical band-shaped spring seat 29 which resiliently presses the front and rear hook sections 24*a* and 24*a* of the inner rail 16 to the bottom wall 14*c* of the outer rail 14 by the spring 28 so as to enable the inner rail 16 to slide in the vertical direction and is supported in at least two vertical positions by the mounting pins 26 inserted through the spring seat 29 is provided between the inner surface of the bottom wall 14*c* and the spring 28 at each of a plurality of positions arranged in the vertical direction, and in that a guide surface 29*a* warped to the side opposite to the inner surface of the bottom wall 14*c* of the outer rail 14 is formed at the lower end of each of the spring seats 29 whereby the inner rail 14 can be inserted between the spring seat 29 and the bottom wall 14*c* from the lower side under the guidance of the guide surface 29*a* at the time when the inner rail 16 is attached to the outer rail 14.

A sheet guide of a sheet shutter according to an eighth aspect of the present invention is featured in that the sheet return guide 17 which has, at the lower end thereof, a connection piece 34 configured to be connected to the upper end of the inner rail 16 and is provided with the engagement guide 21 and the inner locking section 22 so as to have the same cross sectional shape as the cross sectional shape of the inner rail 16 is connected to the upper end of the inner rail 16 by the connection piece 34, and in that a return groove 31 configured to guide and return, into the engagement guide 21, the guide projection 10 of the sheet 2 being lifted in the disengaged state from the engagement guide 21 of the inner rail 16 is provided at the lower end side of the sheet return guide 17.

A sheet guide of a sheet shutter according to a ninth aspect of the present invention is featured in that a lubrication member 36 configured to be exposed in the engagement guide 21 to supply lubricant to the guide projection 10 being lifted and lowered in the engagement guide 21 is provided at the upper end side of the sheet return guide 17.

A sheet guide of a sheet shutter according to a tenth aspect of the present invention is featured in that the same pin groove 24*b* as the pin groove 24*b* of the inner rail 16 is provided at the outside end of the sheet return guide 17, in that the mounting pin 26, the spring 28, and the spring seat 29 are accommodated in the sheet return guide 17, and in that the inner rail 16 is attached so as to be resiliently press-contacted with the side of the outer rail 14 by the mounting pin 26 whereby the upper end of the inner rail 16 can be inserted between the spring seat 29 and the inner surface of the bottom wall 14*c* of the outer rail 14 from the lower side at the time when the inner rail 16 is attached to the outer rail 14.

DETAILED DESCRIPTION OF THE PREFERRED EMBODIMENTS

Figure 1:
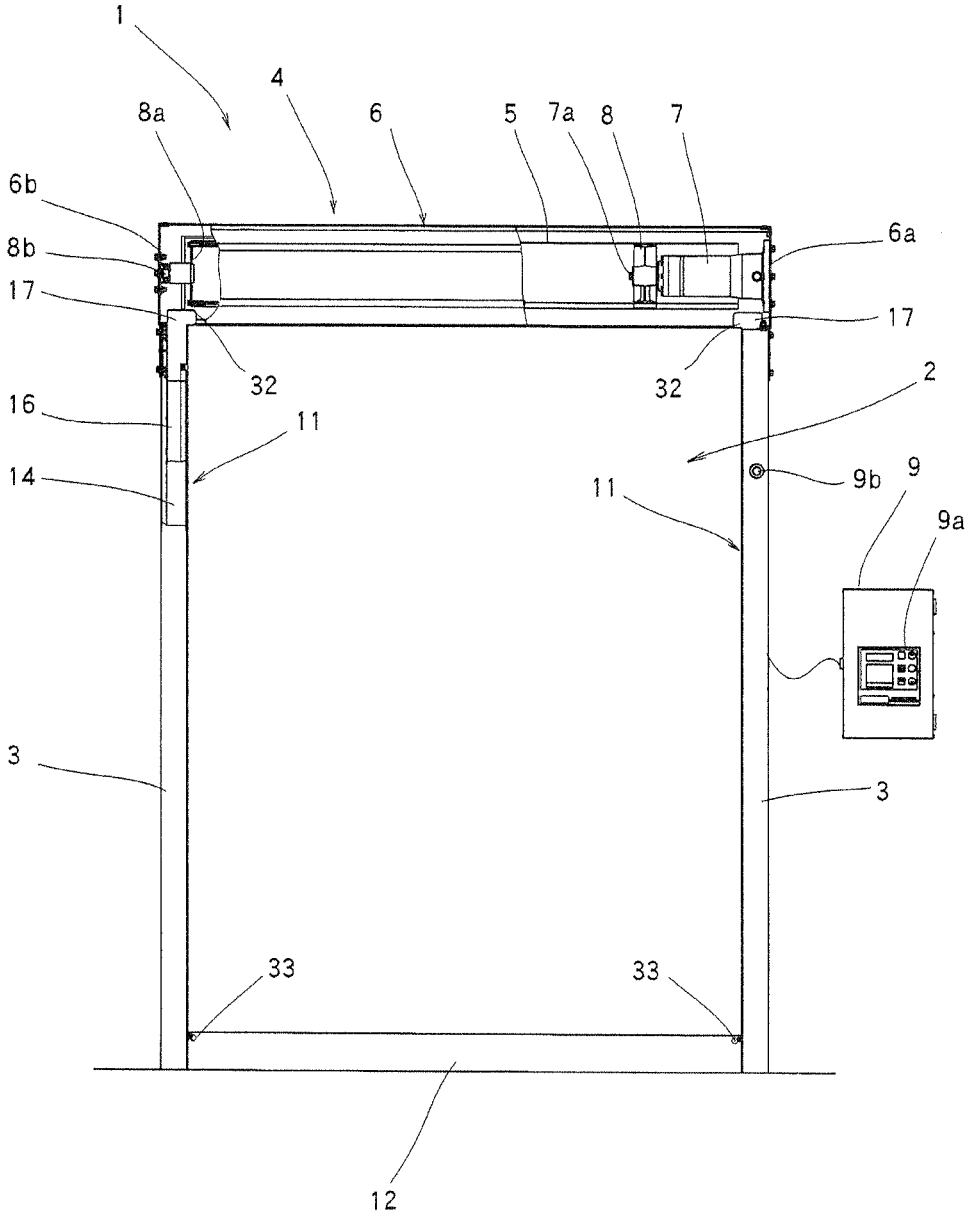
FIG. 1 is a front view, shown partly in section, of a sheet shutter to which the present invention is applied.

Embodiments according to the present invention will be described with reference to the accompanying drawings. FIG. 1 is an overall front view of a sheet shutter using a sheet guide according to the present invention. Reference numeral 1 denotes a sheet shutter installed mainly in an entrance of a building, and is configured by a sheet 2 for the shutter, support posts 3 (side frames) which are configured as guide members for supporting the left and right sides of the sheet 2 so as to guide the vertical up and down movement of the sheet 2, a cylindrical sheet case 4 which houses an opening and closing mechanism of the sheet 2, and the like. The support post 3 is attached and fixed to and along a post or a wall which is arranged at an entrance of a building. The sheet case 4 is laterally installed along the beam or the wall surface of the building, and is attached in the state of being mounted on the left and right support posts 3.

In the sheet shutter 1 shown in FIG. 1, in the state where the sheet case 4 is mounted on the left and right support posts 3, each side of the sheet case 4 is detachably connected to each of attaching members 3*a* respectively fixed to the upper outside portion of the support posts 3. Further, a sheet drum (unwinding apparatus) 5 as a shutter opening and closing mechanism is housed in the sheet case 4, and the winding and unwinding of the sheet 2 is performed by the normal and reverse rotation of the sheet drum 5. Each side of the sheet 2 is vertically slidably supported by each of sheet guides respectively provided in the left and right support posts 3, so that the sheet is lifted and lowered so as to open and close the entrance.

The entire configuration of the sheet shutter 1 will be first described with reference to FIG. 1 to FIG. 4. The sheet case 4 has a hollow case chamber formed by detachably attaching end plates 6*a* and 6*b* to both sides of a cylindrical case main body 6 having a quadrangular cross section in side view. The hollow cylindrical sheet drum 5 rotatably journaled by the left and right end plates 6*a* and 6*b* is accommodated in the case chamber along the axial direction of the drum. Further, an opening section 6*c* connected to the upper ends of the left and right support posts 3 to allow the up and down movement of the sheet 2 is formed in the rear lower portion of the case main body 6.

The proximal end portion of a motor 7 having a columnar shape is attached to the inside surface of the right end plate 6*a* of the case main body 6 with a bolt so that the motor 7 is supported to face the inside of the sheet drum 5. The motor 7 has a drive shaft 7*a* for journaling a ring-shaped drive body 8 which is spline-fitted to the inner surface of the sheet drum 5 so as to normally and reversely rotate the sheet drum 5.

The end plate 6*b* on the left side of the case main body 6 is attached so as to close the left end portion of the case main body 6, and rotatably supports a support shaft 8*b* of a mounting plate 8*a* attached to the left end portion of the sheet drum 5. Thereby, the sheet drum 5 is horizontally journaled in the sheet case 4, and the sheet 2 is unwound and lowered (moved forward) or wound and lifted (moved backward) according to the normal or reverse rotation of the motor 7, so that the entrance of the building is closed or opened.

Further, the opening and closing operation of the sheet 2 is performed by the normal and reverse rotation control of the motor 7 based on a manual operation command from an operation switch 9*a* installed in a control panel 9, a detection command from a detection section 9*b* for detecting a passing body, and the like, similarly to the conventional sheet shutter.

Figure 2:
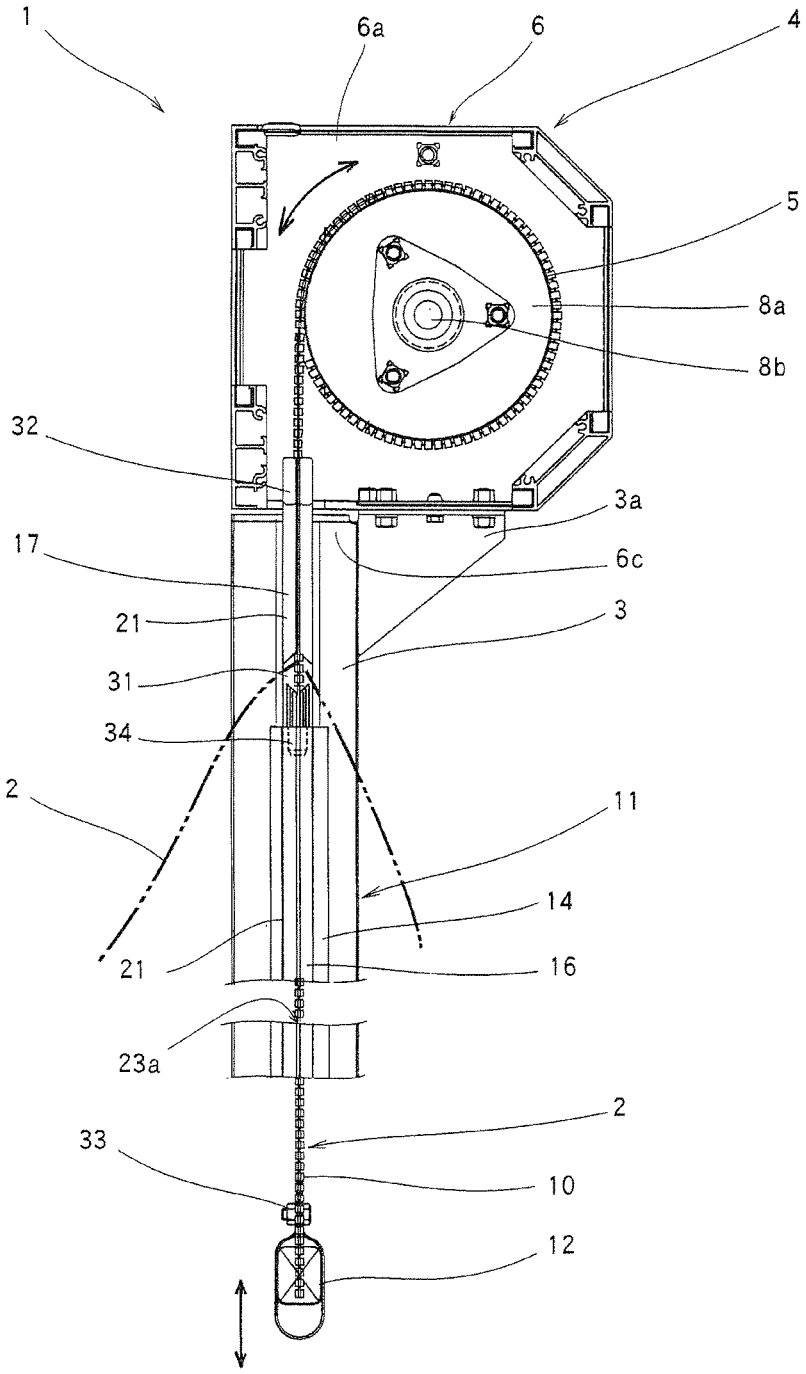
FIG. 2 is a sectional side view showing a configuration of a main part of FIG. 1.

FIG. 2 is a sectional side view showing an internal configuration of the sheet shutter described above. The sheet 2 formed by a translucent and flexible rectangular curtain made of a synthetic resin, and the upper end (proximal end side) of the sheet 2 is attached to the peripheral surface of the sheet drum 5 along the axial direction of the sheet drum 5. The sheet 2 shown in FIG. 2 has a number of piece-shaped guide projections 10 in a known configuration provided along the edges on both sides of the curtain at a predetermined interval, and the guide projections 10 are vertically slidably and engagingly accommodated in a sheet guide section 11 configured on each of the mutually inward facing sides of the support posts 3. Thereby, the sheet 2 is smoothly lifted and lowered in a laterally stretched state while each side of the sheet 2 is engaged and guided by the sheet guide section 11.

Further, a straight grounding section 12, which brings the sheet 2 into contact with the ground, the floor surface, or the like (hereinafter referred to as floor surface) in an air-tight manner in the closed state where the sheet 2 is lowered most, is provided at the lower end of the sheet 2. The grounding section 12 also serves as a weight section with a weight therein, so that the sheet 2 is vertically stretched by the weight.

The sheet guide section 11 is configured as shown in FIG. 4 to FIG. 7, and the support post 3 has a hollow quadrangular C-shaped cross section. In the support post 3, an outer rail 14 having a U-shaped cross section is accommodated as shown in the figure. At both the front and rear outer sides of the open ends of the outer rail 14, grooves 13 are formed along the direction of the support post 3 so as to respectively engage the front and rear open ends of the support post 3, and thereby the outer rail 14 is attached and fixed to the support post 3 by respectively fitting the open ends of the support post 3 to the grooves 13. An inner rail 16 and a sheet return guide 17 connected to the upper portion of the inner rail 16 are fitted to each other so as to be detachably attached in a rail groove 14*b* formed by front and rear side walls 14*a* and 14*a* of the U-shaped cross section. Note that the outer rail 14, the inner rail 16, and the sheet return guide 17 are formed of a synthetic resin material having abrasion resistance and a certain extent of flexibility.

Figure 5:
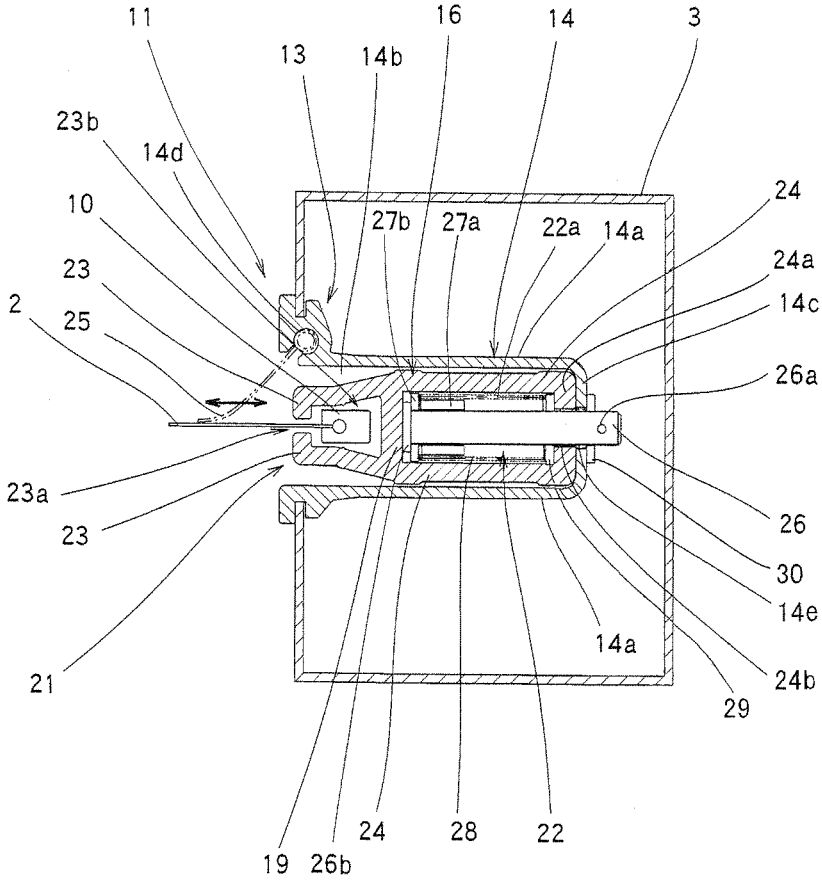
FIG. 5 is a sectional view showing a configuration of a support post and the sheet guide section.

As shown in the horizontal cross section of FIG. 5, the inner rail 16 is configured such that an inward facing engagement guide 21 for vertically slidably and engagingly accommodating the guide projections 10 attached to the sheet 2, and an inner locking section 22 (main body section) for attaching the inner rail 16 to the outer rail 14 resiliently in the stretching direction of the sheet 2 are integrally formed respectively on the left and right sides of an intermediate wall 19 provided in the rail member of the inner rail 16 in the direction of the support post.

The engagement guide 21 is formed by guide walls 23 respectively having a pair of mutually inward facing hook-shaped tip sections and respectively projecting inward from the front and rear sides of the intermediate wall 19. A sheet groove 23*a* is formed between the hook sections respectively formed at the tip sections of the guide walls 23 and 23, and a guide groove 23*b* is formed in the inside between the guide walls 23 and 23.

The sheet groove 23*a*, which is formed between the inward-facing hook sections respectively formed at the tip sections of the guide walls 23 and 23, accommodates the sheet 2 and guides the up and down movement of the sheet 2 while limiting the swing of the sheet 2 in the front and rear direction.

Further, the guide groove 23*b* is formed between the inner surfaces of the guide walls 23 and 23, which surfaces are connected to the sheet groove 23*a*, and the intermediate wall 19, and is formed into a shape allowing the guide projection 10 to be moved in the left and right direction. Further, the guide walls 23 and 23 have an approximately fixed thickness, and thereby the guide walls 23 and 23 can be resiliently deformed in both the front and rear direction.

Thereby, as shown in FIG. 5, in the attitude in which the inner rail 16 is mounted in the outer rail 14, and in the state where the guide projection 10 of the sheet 2 is accommodated in the guide groove 23*b* of the engagement guide 21, the guide groove 23*b* allows the guide projection 10 to slide in the vertical direction while preventing the guide projection 10 from coming off in the inward direction.

That is, even when the guide projection 10 is about to come off from the guide groove 23*b* by widening the sheet groove 23*a* in response to a wind pressure received by the sheet 2 during the lifting or lowering of the sheet 2, the coming-off of the guide projection 10 is prevented by the hook shape of the front and rear guide walls 23, and hence the sheet 2 can be guided to be smoothly lifted or lowered.

The inner locking section 22 has a hollow section 22*a* formed by the intermediate wall 19 and side walls 24 and 24 projected from both sides of the intermediate wall 19 to the outward direction in parallel with each other. A hook section 24*a* is provided by bending inward the outside end of each of the side walls 24 and 24, so that a pin groove 24*b* which allows a mounting pin 26 to be vertically slidably inserted between the hook sections 24*a* and 24*a* is formed in the direction of the rail.

In this configuration, the inner locking section 22 accommodates, in the hollow section 22*a*, the outward directed mounting pin 26 having a flange-shaped head section 26*b* at the inside end portion thereof, a coil-shaped spring 28 mounted on the outside of the mounting pin 26, a spacer 27*a* inserted between the spring 28 and the mounting pin 26 and limiting the compression of the spring 28, and a band-shaped spring seat 29 receiving the outside end portion of the spring 28. Further, the mounting pin 26 has a length to allow the pin end portion thereof to project from the pin groove 24*b* and a mounting hole 14*e* (long hole) in the state where the head section of the mounting pin 26 is press-contacted with the intermediate wall 19 by the resilient force of the spring 28. Reference character 27*b* denotes a washer fitted on the side of the head section of the mounting pin 26 so as to receive the end of the spring 28.

In the state where the mounting pin 26 is supported by being resiliently pulled to the inner side, the mounting pin 26 is attached in such a manner that the portion of the mounting pin 26, which portion is projected from the pin groove 24*b*, is inserted into the mounting hole 14*e* bored in a bottom wall 14*c* of the outer rail 14 so as to project from the bottom wall 14*c*, that a vertical band-shaped receiving seat 30 is attached to the projected portion of the mounting pin 26, and that a stop 26*a* made of a stop pin, and the like, is detachably attached to the pin end section.

As described above, the mounting pin 26 inserted into the spring 28 is inserted in each of the plurality of mounting holes 14*e* bored in the outer rail 14 at a predetermined mounting interval in the direction of the rail, and the inner locking section 22 is also supported by each of the mounting holes 14*e*.

Figure 3:
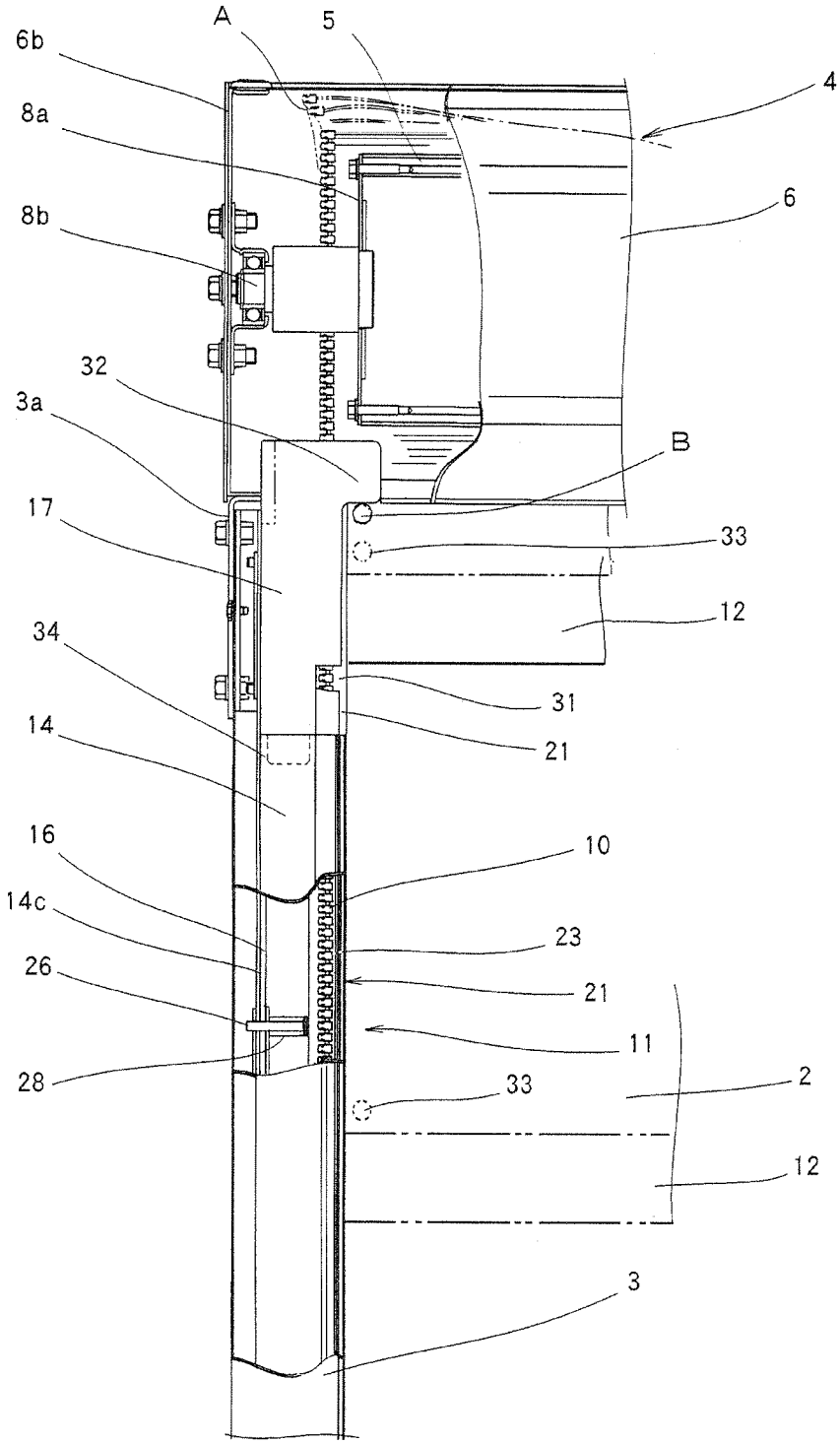
FIG. 3 is a front sectional view showing a configuration of a left side portion of the sheet case and the sheet guide section shown in FIG. 1.

Thereby, as shown in FIG. 3 and FIG. 5, the inner rail 16 is attached in the outer rail 14 by the mounting pins 26, and is uniformly press-contacted with the bottom wall 14*c* of the outer rail 14 over the entire length of the inner rail 16 by the outward resilient force of each of the springs 28. As a result, the engagement guide 21 can resiliently support the sheet 2 in the outward stretching direction of the sheet 2 via the guide projection 10. It is preferred that the mounting pin 26 is configured to have a length to allow the head section to be in contact with the intermediate wall 19 in the hollow section 22*a* of the inner rail 16.

Note that a mounting groove 14*d*, which has a C-shaped cross section and to which a seal member 25 configured to be resiliently brought into contact with the sheet 2 in the vertical direction is detachably attached, is formed at the opening end of at least one of the front and rear side walls 14*a* of the outer rail 14 in the direction of the support post. As shown by the dotted line in FIG. 5, the seal member 25, the side end of which is attached to the mounting groove 14*d*, is resiliently brought into contact with the sheet 2. Thereby, the wind which is going to enter into the rail groove 14*b* can be shielded, and also the swing of the sheet 2 in the front and rear direction can be limited.

Figure 4:
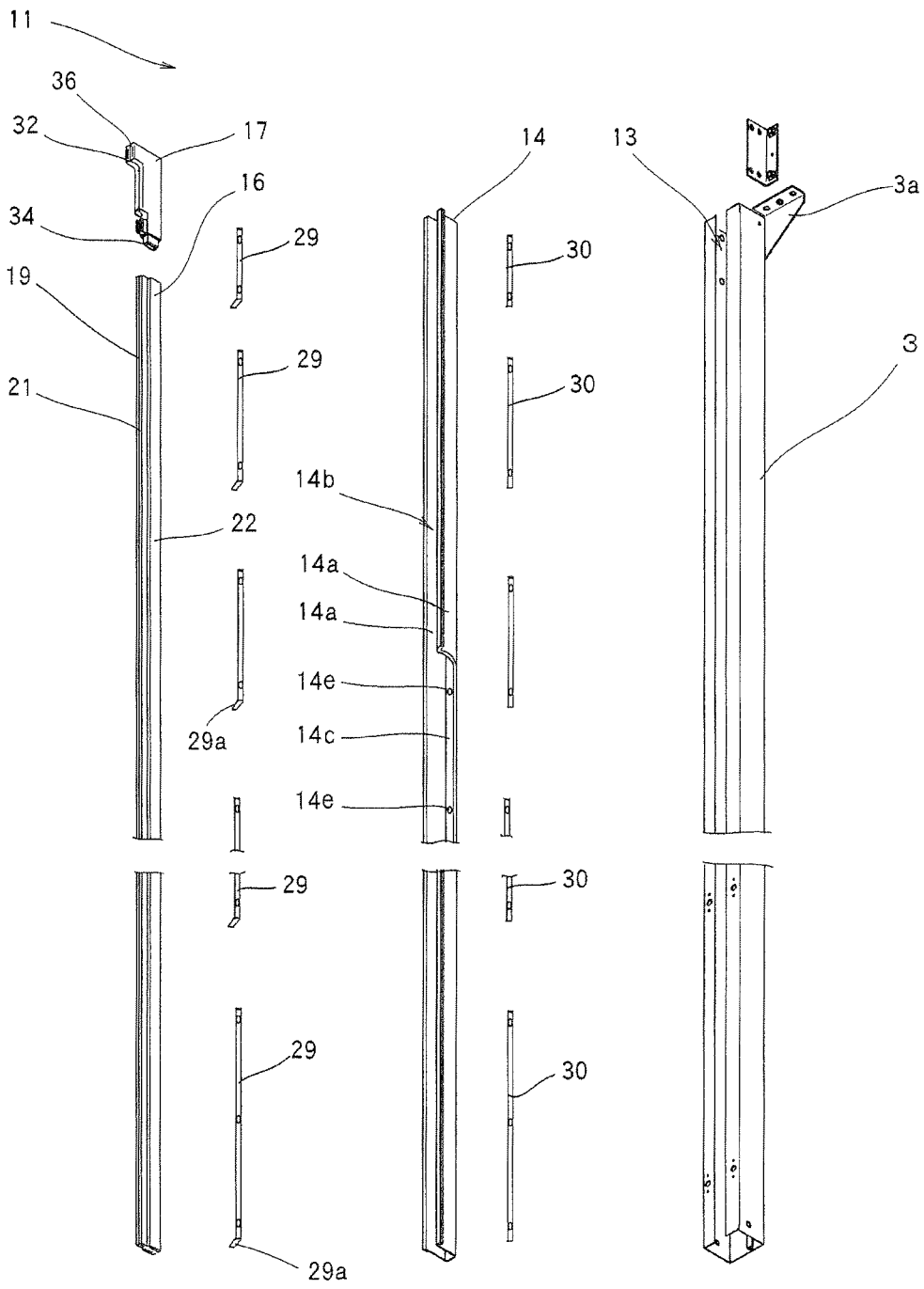
FIG. 4 is a perspective view showing a configuration of the sheet guide section which is disassembled.
Figure 9:
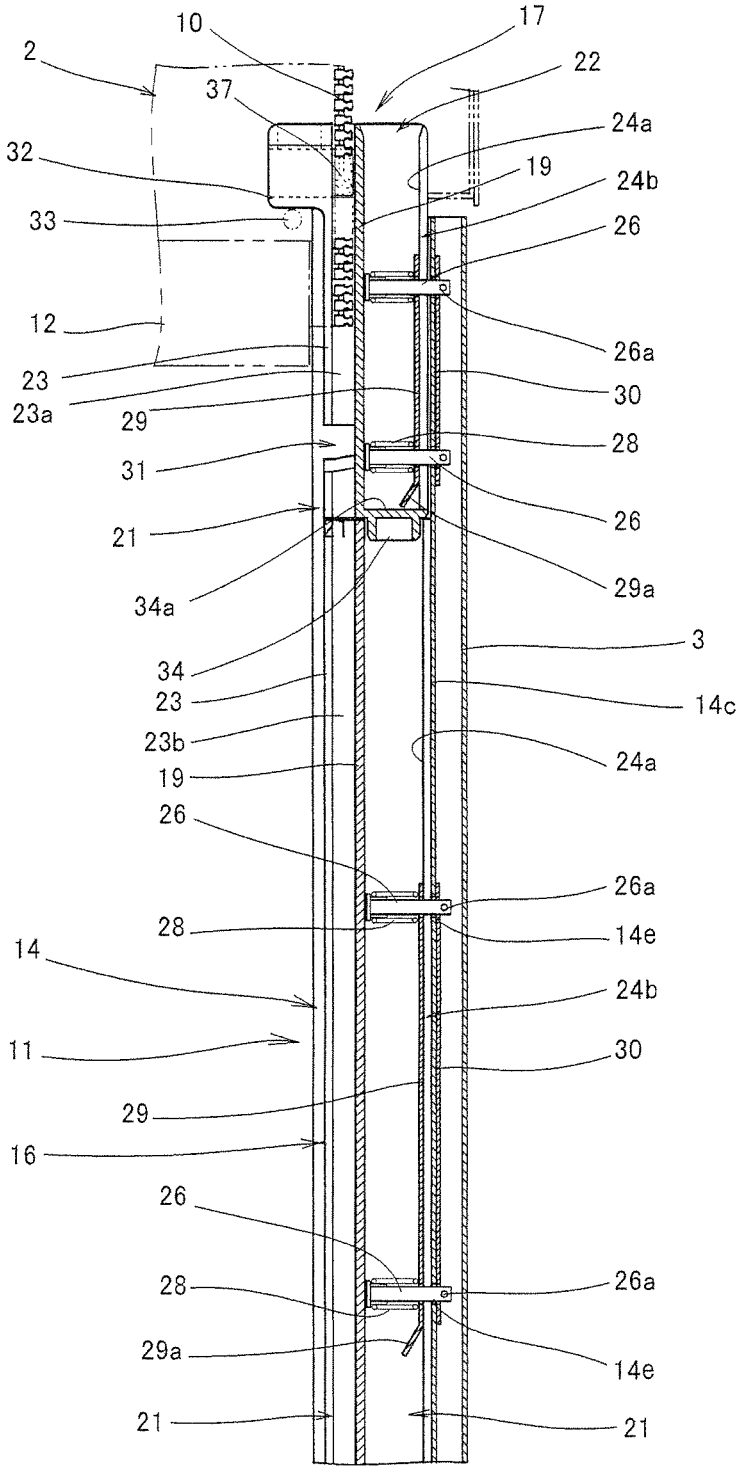
FIG. 9 is a partial sectional view showing a configuration of the sheet guide section on the right side.

Further, in the above described configuration, as shown with FIG. 4 and FIG. 9, the spring seat 29 and the receiving seat 30 act as vertical band-shaped washers through which the plurality of adjacent mounting pins 26 (two to three in the illustrated example) are inserted at positions where the spring seat 29 and the receiving seat 30 face each other. Between the spring seat 29 and the receiving seat 30, the hook section 24*a* of the inner rail 16 is supported by being resiliently pressed against the bottom wall 14*c* of the outer rail 14.

Thereby, the inner rail 16 is brought into contact with the outer rail 14 with substantially uniform contact pressure over the entire length of the inner rail 16 by the plurality of mounting pins 26, the springs 28, and the vertical spring seats 29.

Further, the receiving seat 30 extending over the plurality of mounting pins 26 dispersedly receives the inward drawing force via the sheet 2 and the guide projection 10, so that the inner portion of the outer rail 14 and the bottom wall 14*c* of the outer rail 14 are pressed with a uniform resilient force over the entire length of the rail.

Therefore, the spring seat 29 and the receiving seat 30 support the hook sections 24*a* of the inner rail 16 and the bottom wall 14*c* of the outer rail 14 with the resilient force substantially uniform over the length of the rail via the long band-shaped surface, and hence the hook sections 24*a* on both sides of the pin groove 24*b* are also brought into contact with the outer rail 14 with the contact pressure substantially uniform in the vertical direction.

Figure 10:
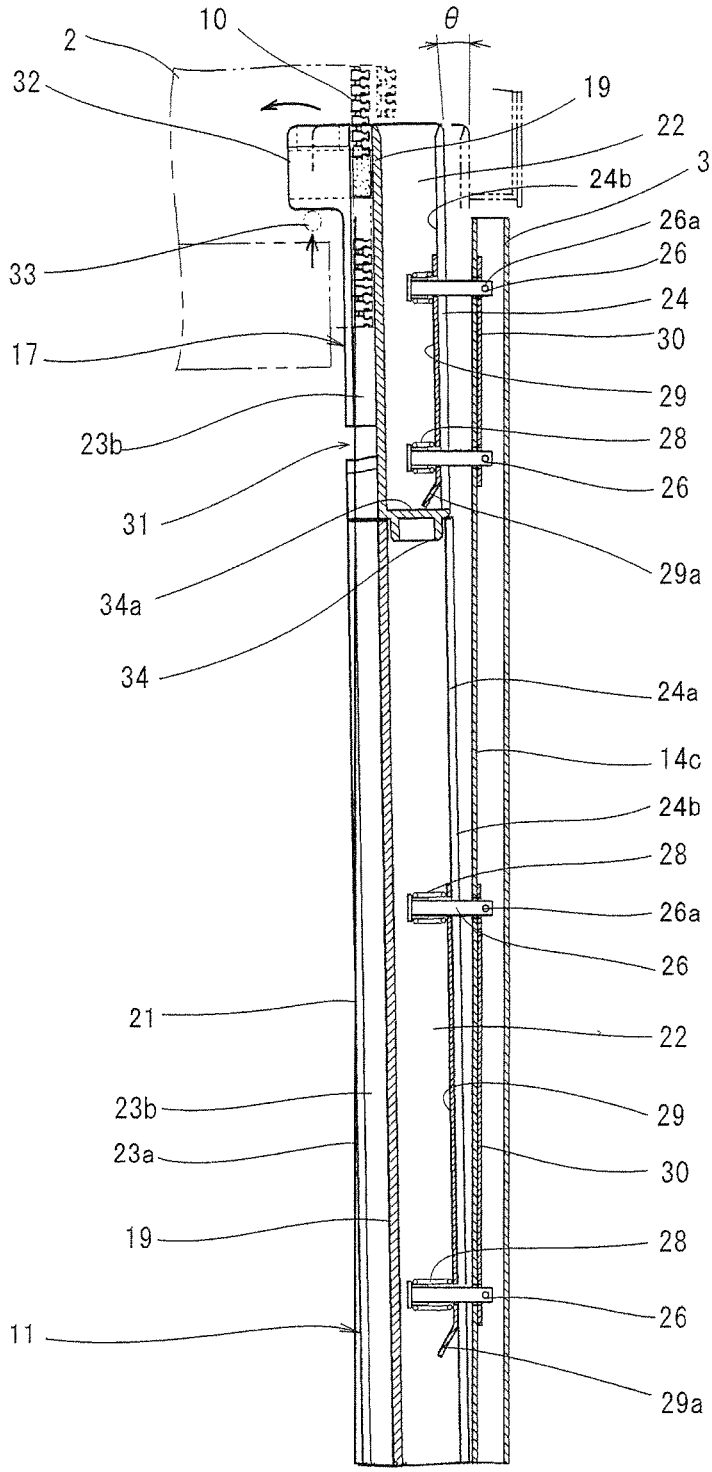
FIG. 10 is a sectional view showing a state where a sheet return guide and the inner rail are moved to the inner side.
Figure 11:
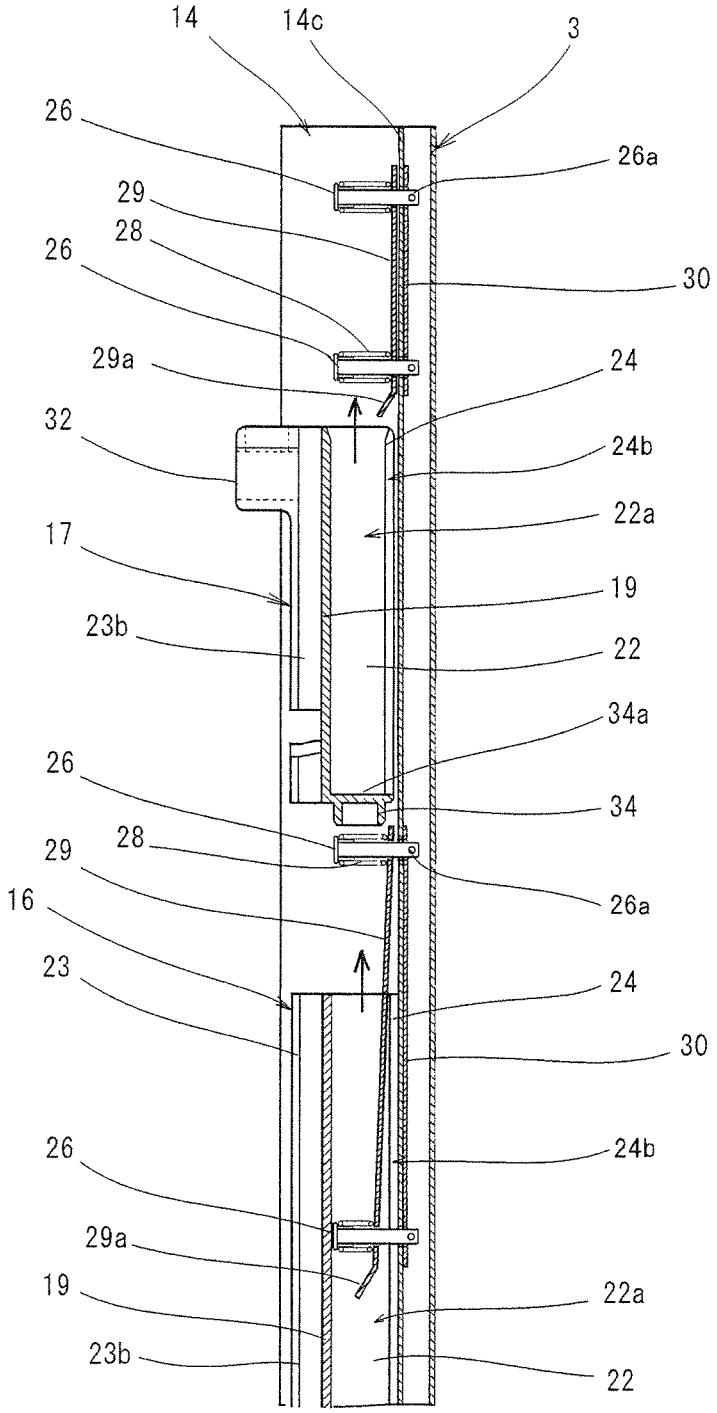
FIG. 11 is a sectional view showing a manner of assembling the sheet return guide and the inner rail.

Further, each of the plurality of divided spring seats 29 arranged in the rail direction at a substantially equal interval as shown in FIG. 4 has, in the above described attached state, a guide surface 29*a* formed by being warped inward at one end (the lower end in the illustrated example) of the spring seat 29 as shown in FIG. 9 to FIG. 11.

Thereby, the outer rail 14 can be assembled in the state where the springs 28, regulation cylinders 28*a*, and the mounting pins 26 inserted through the spring seats 29 are attached beforehand to the outer rail 14 via the receiving seats 30 and the stops 26*a*. Thus, thereafter, the outer rail 14 can be easily assembled with the inner rail 16 by inserting the inner rail 16 from the end portion of the outer rail 14.

That is, the spring seats 29 supported by the plurality of mounting pins 26 inserted therethrough are aligned in the direction in which the installation side of each of the guide surfaces 29*a* is the lower side of the support post 3. Thus, as shown in FIG. 11, the inner rail 16 can be inserted into the outer rail 14 from the lower side and pressed toward the upper side of the outer rail 14. Thereby, the tip of the hook section 24*a* of the inner rail 16 can be guided to the guide surface 29*a* of the first spring seat 29 located at the lowermost portion of the outer rail 14. Thus, through the space between the guide-angle inclined guide surface 29*a* of the first spring seat 29 and the bottom wall 14*c* of the outer rail 14, the inner rail 16 can be inserted between the first spring seat 29 and the bottom wall 14*c* while the inner rail 16 is pushed to move inward counter to the resilient force of the spring 28.

Then, when the inner rail 16 is further inserted, the inner rail 16 can be slid between the first spring seat 29 and the bottom wall 14*c*, so as to reach between the guide surface 29*a* of the second spring seat 29 and the bottom wall 14*c*. Then, similarly to the first spring seat 29, while the second spring seat 29 is pushed inward by the contact between the guide surface 29*a* and the hook section 24*a*, the inner rail 16 is inserted between the second spring seat 29 and the bottom wall 14*c*. In the similar way, the inner rail 16 can be successively inserted between the guide surface 29*a* of the subsequent spring seats 29 and the bottom wall 14*c*. Therefore, the assembling of the inner rail 16 to the outer rail 14 can be efficiently performed as compared with the case where the assembling of the inner rail 16 to the outer rail 14 is performed by inserting each of the mounting pins 26 into the mounting hole 14*e* of the outer rail 14 and a doughnut plate-shaped washer 27*b*. Further, when the doughnut plate-shaped washer 27*b* is provided instead of the band-shaped receiving seat 30, there is a problem that the portion of the mounting hole 14*e* of the outer rail 14 wears due to the contact with the doughnut plate-shaped washer 27*b*.

Figure 6:
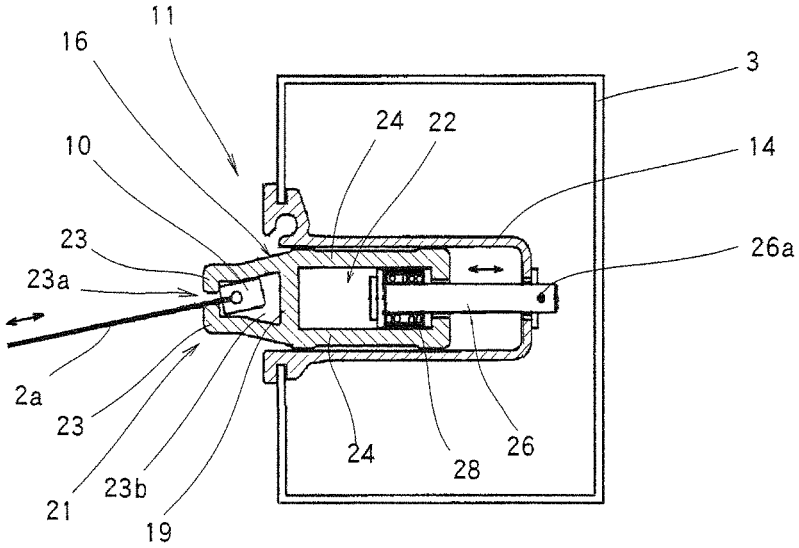
FIG. 6 is a sectional view showing a state where the inner rail shown in FIG. 5 is moved to the inner side.

In the sheet guide configured as described above, when the sheet 2 receives a strong force in the front or rear direction perpendicular to the sheet surface due to a strong wind, or the like, the inner rail 16 receives a tensile force in the inward direction via the sheet 2 and the guide projection 10 as shown with FIG. 6. At this time, the inner rail 16 is slid in the inward direction in the outer rail 14 counter to the resilient force of the spring 28, and hence the tensile force due to the wind can be buffered.

In such a case where a passing object, such as a car, collides with the sheet 2 and where the sheet 2 is thereby strongly pushed in the front or rear direction, the inner rail 16 is slid to reach the limit of slide movement determined by the mounting pin 26 as shown in FIG. 6, so that the guide projection 10 is made to incline in the pressing direction, so as to act to widen the space between the guide walls 23 and 23 counter to the resilient force of the guide walls.

Thereby, the guide projection 10 resiliently widens the space between the guide walls 23 and 23, so as to be disengaged from the hook section of the guide walls 23 and 23. Thus, the guide projection 10 comes off from the widened sheet groove 23*a* of the engagement guide 21, so as to be detached from the inner rail 16.

Therefore, the sheet 2, which is detached from the inner rail 16 to become free from the support of the support post 3, is released from the excessive tensile force due to the pressing force, and hence the sheet 2 and the guide projection 10 can be prevented from being damaged. Further, the above described mechanism can also prevent the damage of the inner rail 16, a related member, and the like, without causing an excessive load.

Figure 12:
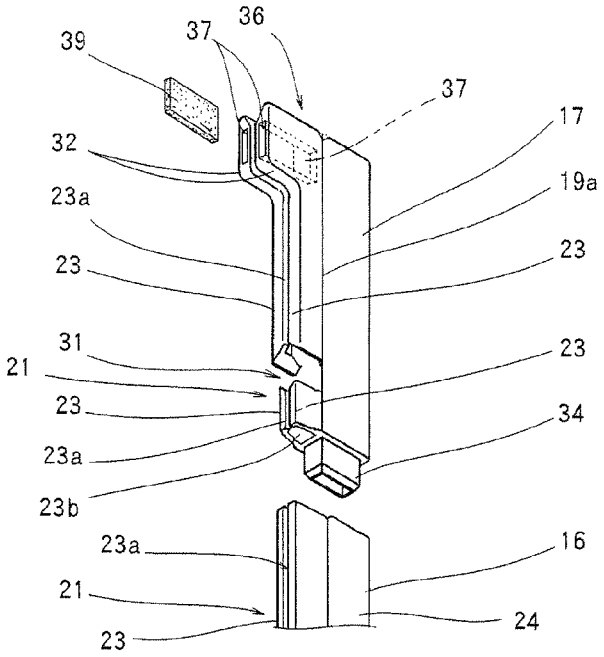
FIG. 12 is a perspective view of the front side of the sheet return guide.
Figure 13:
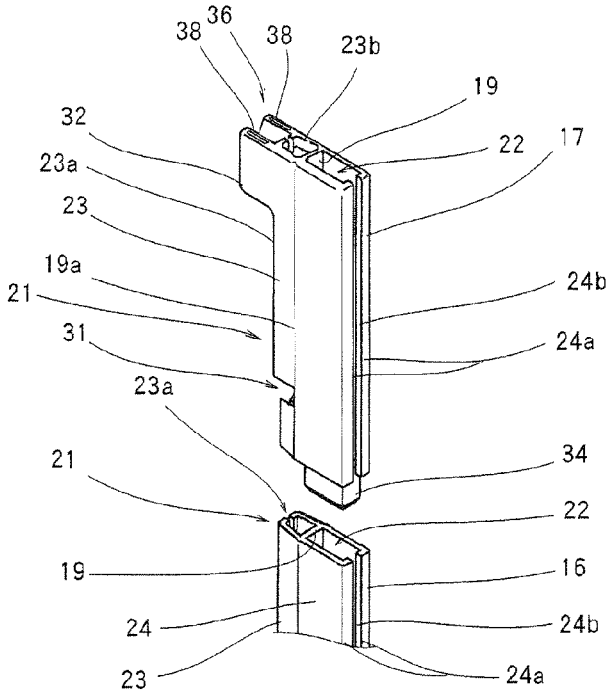
FIG. 13 is a perspective view of the rear side of the sheet return guide.

Next, the sheet return guide 17 shown in FIG. 11 and FIG. 12 will be described. As shown in FIG. 1 to FIG. 4 and FIG. 9, the sheet return guide 17 is inserted into and connected to the upper portion of the inner rail 16 in the outer rail 14. Thereby, the sheet return guide 17 can guide the winding and unwinding of the sheet 2. Further, as shown by the dotted lines in FIG. 2, when the sheet 2 is wound, the sheet return guide 17 can also return the sheet 2 detached from the sheet guide section 11 of the support post 3 to the original attitude, so that the sheet 2 can be unwound in the proper attitude.

Figure 8:
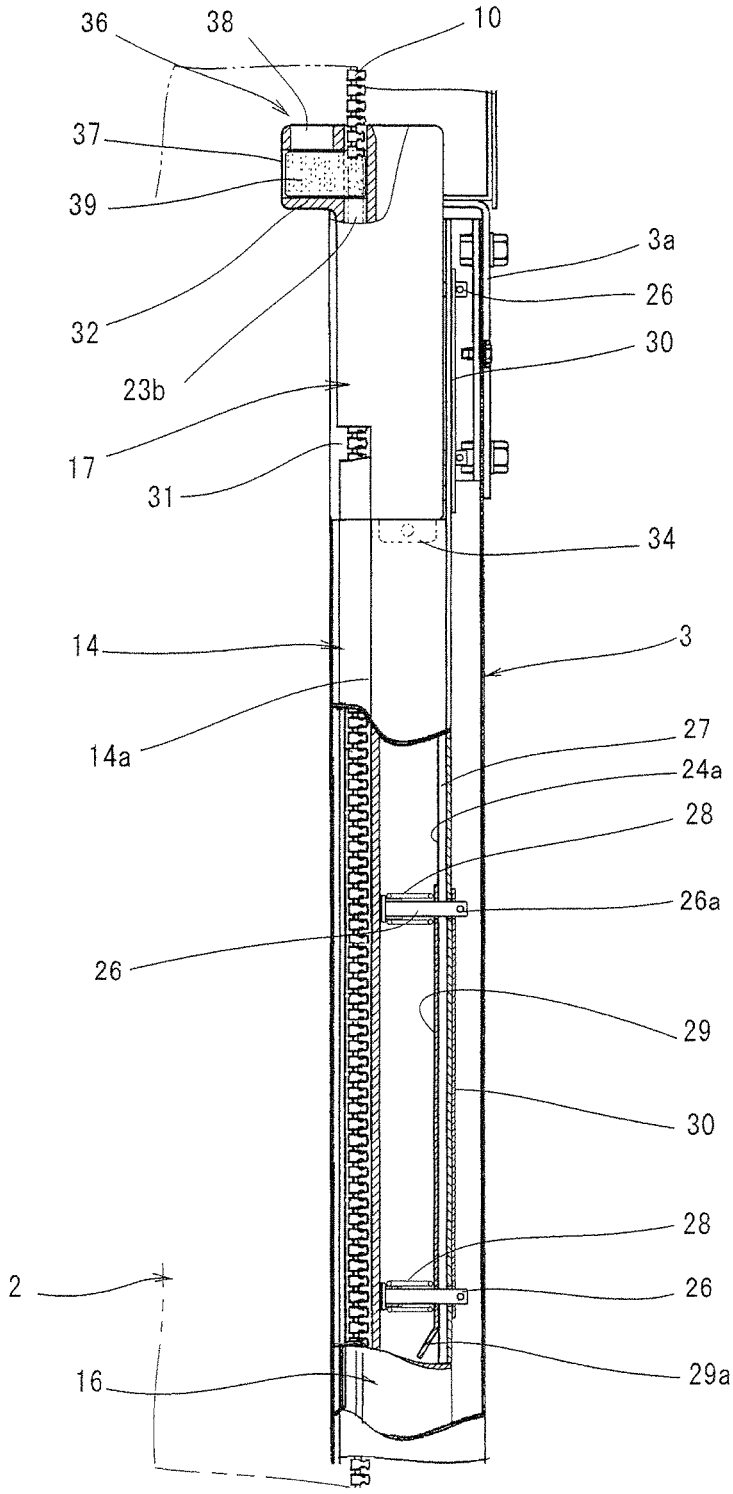
FIG. 8 is a partial sectional view showing a configuration of the sheet guide section and a lubrication section on the right side.

The sheet return guide 17 is made of a synthetic resin and has substantially the same cross sectional shape as that of the inner rail 16. That is, as shown with FIG. 8 and FIG. 9, the sheet return guide 17 has the engagement guide 21 in which the intermediate wall 19 is formed in the intermediate portion of the guide main body and in which the guide groove 23*b* for accommodating the guide projection 10 is formed in the inner side of the intermediate wall 19. Further, in the outer side of the intermediate wall 19, the inner locking section 22 is formed in which the spring 28 for urging the guide projection 10 outward is accommodated in the state where the mounting pin 26 is inserted into the spring 28.

Further, the sheet return guide 17 is provided with a return groove 31 formed by a notch which has a vertical width for introducing the detached sheet 2 and which is formed in an intermediate portion of the engagement guide 21. Further, each of the pairs of the guide walls 23 and 23, which are respectively located at the upper and lower sides of the entry portion of the return groove 31, is formed as mutually facing end surfaces inclined in a V-shape. Thereby, by the inclined end surfaces at the entry portion of the guide walls 23 and 23, the sheet 2 and the guide projection 10 are smoothly guided and introduced into the sheet groove 23*a* and the guide groove 23*b* from the upper or lower portion of the return groove 31.

A sheet stopper piece 32 formed by extending the guide walls 23 in the inward direction is integrally projected at the upper portion of the guide main body of the sheet return guide 17. At the time of a mal winding operation of the sheet 2, the sheet stopper piece 32 receives a stopper 33 provided on each side of the grounding section 12, so that the entanglement of the grounding section 12 can be prevented by restricting the further lifting of the sheet 2.

In the restricted state, since the sheet drum 5 is rotated until the rotation of the motor 7 is stopped by the detection command of overload detection means, the wound sheet 2 is tightly wound to remove bulging and creases caused at the time of winding, and thereby the winding diameter is properly corrected so that the winding diameters on the right and left sides of the sheet 2 are made substantially equal to each other. In this way, when the sheet drum 5 is rotated to unwind the sheet 2 after the rotation of the motor 7 is stopped by the command of overload detection, the slack at the early stage of the lowering can be removed, and the inclination of the grounding section 12 can be prevented so as to bring the grounding section 12 into proper contact with the ground.

Further, in the sheet return guide 17, the lower portion of the hollow section 22*a* of the inner locking section 22 is closed by a lower wall 34*a* (see FIG. 9 to FIG. 11), and a connection piece 34 having a shape and length fitted to the inner locking section 22 of the inner rail 16 is projected from the lower wall 34*a*.

Thereby, the connection piece 34 of the sheet return guide 17 can be fitted into the inner locking section 22 of the inner rail 16, so that the guide walls 23 and 23, the guide groove 23*b*, and the inner locking section 22 can be connected in series.

Further, when the sheet return guide 17 is connected to the inner locking section 22 of the inner rail 16, the connection piece 34 is connected to the hollow section 22*a* of the inner locking section 22 with a slight clearance. Thereby, at the upper portion of the inner locking section 22 of the inner rail 16, the sheet return guide 17 is moved around the connecting section with the inner rail 16 as a fulcrum in the inward and outward directions within the range of the clearance. Even when the amount of movement exceeds the permissible level, the connected state is maintained by the resilience of the inner rail 16.

The sheet return guide 17 configured as described above is attached, as shown in FIG. 9, to the outer rail 14 by the two upper and lower mounting pins 26 in the same way as the inner rail 16 described above. In this mounting state, the vertical movement of the spring seat 29 in the outer rail 14 is restricted by the mounting pins 26, and the lower end of the spring seat 29 is attached close to or in contact with the lower wall 34*a* on the lower end side of the return guide 17 (see FIG. 9). That is, the spring seat 29 provided at the uppermost position is fixed to the outer rail 14, and hence acts as a stopper to prevent the return guide 17 from coming off from the inner rail 16 at the time when the return guide 17 receives an upward force.

Thereby, when the sheet 2 is lifted to cause the stopper 33 to collide with the sheet stopper piece 32 and thereby the sheet return guide 17 receives a load in the upward extracting direction, the return guide 17 can be prevented from coming off from the inner rail 16 by the spring seat 29. Note that when the connection piece 34 and the outer rail 14 are connected to each other by a screw, or the like, it is also possible to prevent the sheet return guide 17 from coming off upward.

Further, a lubrication member 36 which is brought into contact with the guide projection 10 to supply lubricant to the guide projection 10 is provided in the sheet return guide 17, so as to provide a mechanism in which, when the sheet 2 and the guide projection 10 are guided to be lifted and lowered, lubrication of substantially the entire region of the guide projection 10 being lifted and lowered is simply and uniformly performed at the uppermost position of the support post 3

That is, as shown in FIG. 8, FIG. 9, FIG. 12, and FIG. 13, the lubrication member 36 is provided so that, in each of the front and rear thick portions of the sheet stopper piece 32 projecting inward from the side of the engagement guide 21, a lubrication hole 37 having a rectangular cross section opened at the inside end of the sheet stopper piece 32 is laterally bored so as to be opened at the end portion of the lubrication hole 37 which portion faces the inside of the guide groove 23*b*. Further, in the lubrication member 36, a supply hole 38 of the lubricant is bored vertically from the upper end of the sheet stopper piece 32 to reach the lubrication hole 37.

A lubricant holding member 39 which holds a lubricant is inserted into the lubrication hole 37 from the inside end portion of the sheet stopper piece 32 so as to allow the insertion end of the lubricant holding member 39 to be exposed in the guide groove 23*b*. The lubricant holding member 39 shown in the figure is made of felt or sponge to be impregnated with a lubricant, such as oil, and is formed in a rectangular plate shape so as to be projected in the guide groove 23*b* in the inserted state. Then, in the state where the lubricating oil supplied from the supply hole 38 is impregnated in the lubricant holding member 39, the lubricating oil is introduced into the guide groove 23*b*.

The lubrication member 36 configured as described above can supply and apply the lubricating oil impregnated in the lubricant holding member 39 to the guide projection 10 moving in the inside of the guide groove 23*b*, from both the front and rear sides of the guide projection 10, and can also uniformly supply an appropriate amount of the lubricating oil to the plurality of guide projections 10. Therefore, the lubricating oil is not consumed more than necessary even when the guide projection 10 is repeatedly lifted and lowered. Further, the lubricating oil supplied from the sheet return guide 17 provided in the upper portion of the support post 3 is also supplied to the guide groove 23*b* of the inner rail 16 under the sheet return guide 17 via the movement of the guide projection 10, and hence the sheet 2 can be smoothly lifted and lowered while the wear of the respective sliding portions and the noise are suppressed.

Further, the lubrication member 36 is provided in the plate-shaped sheet stopper piece 32 provided projectingly from the sheet return guide 17, and hence can be compactly configured. Further, the lubrication member 36 can be made to face the opening section 6*c* of the case main body 6, and hence the lubricating oil can be easily supplied to the supply hole 38 or the lubrication hole 37 from this large space.

Further, it is also possible to easily perform the exchange work of the lubricant holding member 39 from the lubrication hole 37 facing the opening section 6*c*.

Next, the mounting form and the effect of the inner rail 16 of the sheet guide section 11, and the sheet return guide 17 will be described. First, as shown with FIG. 11, according to the assembly form described above, the mounting pins 26, each of which is fitted into the spring 28 and the spacer 27*a*, and the number of which corresponds to the length of the outer rail 14, are respectively inserted into the mounting holes 14*e* of the bottom wall 14*c*, so as be attached to the outer rail 14 in the state where the bottom wall 14*c* is sandwiched between the spring seat 29 and the receiving seat 30.

Then, as shown in FIG. 11, the sheet return guide 17 is inserted between the second and third mounting pins 26 in the rail groove 14*b* from the opening side of the rail groove 14*b* so that the upper end of the hook section 24*a* of the sheet return guide 17 is placed between the guide surface 29*a* of the spring seat 29 and the bottom wall 14*c*. Then, the sheet return guide 17 is inserted in the arrow direction (upward). Thereby, counter to the resilient force of the spring 28, the upper end of the hook section 24*a* of the sheet return guide 17 pushes inward the spring seat 29 while sliding along the inclined surface of the guide surface 29*a*. Thereby, the sheet return guide 17 can be inserted between the spring seat 29 and the bottom wall 14*c*.

Then, the sheet return guide 17 can be moved while the mounting pins 26 and 26 are inserted into the pin grooves 24*b*. The sheet return guide 17 is set to be positioned and supported at the position shown in FIG. 9 where the lower wall 34*a* is brought into contact with the tip of the guide surface 29*a*.

Next, the inner rail 16 is pushed in the arrow direction so as to be inserted between the guide surface 29*a* of the spring seat 29 located at the lower end of the outer rail 14 and the bottom wall 14*c*. Thereby, while the upper end of the hook section 24*a* of the inner rail 16 pushes inward the spring seat 29 by sliding the incline surface of the guide surface 29*a*, the mounting pins 26 and 26 are accommodated in the pin grooves 24*b* as shown in FIG. 11, so that the inner rail 16 can be inserted into the lower portion of the guide surface 29*a* of the spring seat 29 located at the next higher position. At this time, the hook section 24*a* of the inner rail 16 is supported in the state of being resiliently sandwiched between the spring seat 29 and the bottom wall 14*c* of the outer rail 14.

Similarly, the inner rail 16 can be successively inserted between the spring seat 29 located at subsequent higher positions and the bottom wall 14*c*. When the inner rail 16 is inserted between the uppermost spring seat 29 and the bottom wall 14*c*, the insertion of the inner rail 16 is completed. When the insertion of the inner rail 16 is completed, the connection piece 34 of the sheet return guide 17 which is set beforehand is inserted into the hollow section 22*a* of the inner locking section 22 of the inner rail 16.

Next, the outer rail 14, into which the inner rail 16 is inserted, is fixed by fitting the front and rear opening ends of the support post 3 into the grooves 13 formed on the outside of both the front and rear opening ends of the outer rail 14. Further, the upper and lower sides of the outer rail 14 can also be fixed by screws to the support post 3 as required. The support post 3 assembled as describe above is detachably connected to each side of the sheet case 4 via the attaching member 3*a*, and a necessary part of the support post 3 is fixed and attached to the building side.

When the sheet guide is disassembled, according the procedure in the order reverse to the above described assembling order, the outer rail 14 is removed from the support post 3, and then the inner rail 16 and the sheet return guide 17 are removed by being moved in the extracting direction with respect to the outer rail 14. When the sheet guide is again assembled for repair, and the like, the new inner rail 16, the new sheet return guide 17, or the like, are assembled in the procedure described above.

Therefore, the inner rail 16 and the sheet return guide 17 can be easily assembled and disassembled by the simple operations such as the insertion and extraction in the direction of the rail, and hence various maintenance works can be efficiently performed. Further, unlike the conventional sheet guide structure in which the conventional inner rail 16 is assembled to the support post 3, it is not necessary to exchange the entire part of the support post 3 detached from the sheet case 4, and it is also possible to exchange only the sheet return guide 17, the inner rail 16, or the support post 3.

Next, the operation and the use form of the sheet shutter 1 will be described. In the sheet shutter 1, the rotation control is performed in such a manner that the sheet 2 is wound by the sheet drum 5 and the rotation of the sheet drum 5 is stopped at the uppermost lift position set to the position just before the stopper 33 is brought into contact with the sheet stopper piece 32 of the sheet return guide 17. The state where the grounding section 12 is stopped at the uppermost lift position above the return groove 31 of the sheet return guide 17 is the standby state for the next lowering operation. When the sheet drum 5 is rotated in the unwinding direction and the sheet 2 is unwound, each of the guide projections 10 of both ends of the sheet 2 is guided by the inner rail 16 of the support post 3 on each of the left and right sides, so as to be slid downward. Then, the sheet drum 5 is automatically stopped at the position where the grounding section 12 is brought into contact with the floor surface, so that the frontage of the sheet shutter 1 is closed in the state where the sheet 2 is stretched in the width (lateral) direction to prevent slack of the sheet 2.

In the case where the sheet 2 of the sheet shutter 1 is in the closed state or where the sheet 2 is lifted or lowered, when the sheet 2 is pressed by receiving a strong wind and the guide projection 10 is about to come off from the engagement guide 21, the coming-off of the guide projection 10 is prevented by the engagement force of the engagement guide 21, and at this time, the inner rail 16 is slid and moved to the inner direction counter the urging force of the spring 28.

Further, when the wind pressure becomes low, the inner rail 16 is returned to the original sheet stretching attitude by the resilience of the spring 28. Therefore, the inner rail 16 can stretch and support the sheet 2, while buffering the wind pressure due to the change of the wind. Also, the inner rail 16 enables the opening and closing operation of the sheet shutter 1 to be smoothly performed while preventing the coming-off of the sheet due to the wind.

When a passing object, such as a car, collides with the sheet 2, the sheet 2 receives a strong external force in the front or rear direction, so that the inner rail 16 reaches the slide limit position as shown in FIG. 6. When the sheet 2 receives a further stronger pressing force, the guide projection 10 is inclined in the pressing direction and acts to forcibly widen the space between that guide walls 23 and 23. Thereby, as shown FIG, 7, the guide projection 10 widens the sheet groove 23*a* to come off from the engagement guide 21. As a result, the guide projection 10 is detached from the inner rail 16, so that the sheet 2 is released from the support by the support post 3 and becomes free. Therefore, the application of a pressing force beyond the endurance limit of the sheet 2 can be avoided, so that the sheet 2 can be prevented from being damaged. Further, the inner rail 16, the related members fixed to the inner rail 16, and the like, are prevented from receiving the load beyond the endurance limit.

As described above, the sheet 2 detached from the inner rail 16 is returned to the original state by the winding rotation of the sheet drum 5. However, at this time, the sheet 2 lifts the position of the guide projection 10 in the free state in the front-and-rear and left-and-right directions while being freely bent in the space between the left and right support posts 3. Further, as described above, when the sheet 2 is wound and lifted, both sides of the detached portion of the sheet 2 on the side of the sheet drum 5 is automatically drawn from the groove opening on one of the detached sides (the front side or the rear side) into the return groove 31 of the sheet return guide 17, so that the sheet 2 is wound around the sheet drum 5 while the deflection of the sheet 2 is corrected at the time when the sheet 2 passes through the sheet groove 23*a* above the return groove 31.

Thereby, at the uppermost lift position where the grounding section 12 is stopped above the return groove 31 of the sheet return guide 17, the sheet 2 is automatically returned in the engagement guide 21 so as to be set in the standby state for lowering, and can again lowered by the unwinding rotation of the sheet drum 5.

However, when the sheet 2 is lifted during the use over a long period of time, for example, in the rare case, the sheet 2 is wound overlappingly around the sheet drum 5 in the state where one side of the sheet 2 is double-folded due to a certain trouble. In this case, as shown by the dotted line A in FIG. 3, the winding diameter of the sheet 2 on the double folded side is increased, so that the sheet 2 is wound in an irregular shape in the left and right direction by the sheet drum 5.

For this reason, the sheet 2 is stopped when the stopper 33 on the side of the larger winding diameter (left side) is received by the sheet stopper piece 32 as shown by the dotted line B in FIG. 3. According to this operation, the stopper 33 of the other side (right side) of the sheet is also received and stopped at the same time by the right sheet stopper piece 32 (see FIG. 9).

In this state, by the winding rotation of the sheet drum 5 during a short time until the motor 7 is stopped by the load detection, the left and right stoppers 33 are respectively locked by the left and right sheet stopper pieces 32 at the same time, and both sides of the sheet 2 pull the sheet return guide 17 in the inward direction via the engagement of the guide projection 10.

At this time, as shown in FIG. 10, the sheet return guide 17 is moved so as to be inclined in the inward direction counter to the resilient force of the springs 28 respectively fitted with the two mounting pins 26. Then, the rotation of the motor 7 is eventually stopped by the detection of the overload caused by the above described movement. Although the further entanglement of the sheet 2 around the sheet drum 5 is prevented, the both sides of the sheet 2 are kept pulled, and hence the inward pulling force remains to act on the sheet return guide 17.

In this way, when the stopper 33 strongly hits the sheet stopper piece 32 to cause the sheet return guide 17 to be moved counter to the resilient force of the springs 28 respectively fitted with the two mounting pins 26, the upper portion of the inner rail 16 connected to the sheet return guide 17 is also moved counter to the resilient force of the springs 28 respectively fitted with the mounting pins 26 provided at the upper side of the inner rail 16. Thereby, as shown in FIG. 10, the sheet return guide 17 and the inner rail 16 as a whole are inclined (moved) by the inclination angle θ about the lower portion of the inner rail 16 as a fulcrum.

At this time, each of the springs 28 on the side of the inner rail 16 are compressed and deformed by each displacement amount corresponding to the inclination of the inner rail 16 based on the inclination angle θ, and the springs 28 of the sheet return guide 17 are also similarly compressed and deformed. Thereby, the return guide 17 and the inner rail 16 as a whole are supported by the distributed resilient force of the plurality of springs 28 located at and above the upper portion of the inner rail 16.

Further, when the stopper 33 more strongly hits the sheet stopper piece 32, and when the spring seat 29 is thereby moved counter to the resilient force of the springs 28 respectively fitted with the two mounting pins 26 so as to reach the movement limit position at which the spring seat 29 is brought into contact with the regulation cylinder 28*a*, the inclination angle θ becomes a maximum value, the guide projection 10 is firmly engaged and held, and the motor 7 is also stopped.

Therefore, each of the springs 28 of the sheet return guide 17 needs not be increased in size and resilient force, and hence the spring 28, which has a small size and a low spring constant similar to those of the spring 28 used for the side of the inner rail 16, can be sufficiently used for the sheet return guide 17. Thereby, the components can be commonly used, and the cushioning characteristic for the inward movement of the sheet return guide 17 and the inner rail 16 can be improved.

Further, the connection piece 34 of the sheet return guide 17 is connected to the fitting portion of the inner rail 16 by providing a clearance between the connection piece 34 and the fitting portion. Thereby, it is possible to further reduce the inward or outward load in the early stage in which the tensile force is applied about the connecting section as a fulcrum.

In this way, in the sheet shutter 1 which prevents the degree of entanglement of the sheet 2 from exceeding the limit, when the sheet 2 again starts to be lowered by the unwinding rotation of the sheet drum 5, the stopper 33 is separated from the sheet stopper piece 32 so as to release the inward pulling force, and hence the inclination angle θ of the sheet return guide 17 and the inner rail 16 is gradually reduced to 0 degree by the resilient force of each of the springs 28. As a result, the sheet return guide 17 and the inner rail 16 are returned to the original guiding attitude so as to smoothly guide the lowering of the sheet 2. Thereby, the double-folded portion of the sheet 2 is also lowered while being stretched, and hence the lifting of the sheet 2 is also smoothly continued.

In the sheet shutter 1 configured to operate as described above, since the inner rail 16 and the sheet return guide 17 are formed to be separated from each other, it is possible to reduce the size of the sheet return guide 17, the conventional type of which has a complicated shape and tends to wear to require a lot of maintenance work, such as the exchange of components, and it is also possible to form the inner rail 16 in a simple shape having excellent durability and thereby to increase the vertical length of the inner rail 16. Further, the inner rail 16 and the outer rail 14 can be manufactured at low cost by a simple method, such as extrusion or drawing processing.

Further, in the state where the plurality of mounting pins 26 respectively inserted into the springs 28 are inserted into the outer rail 14, the inner rail 16 is attached by the receiving seats 30 and the vertically long band-shaped spring seats 29 for enabling the adjacent mounting pins 26 to be associated with each other. Thereby, the inner rail 16 can be stably supported along the support post 3. Also, the inner rail 16 can be supported in such a manner that the outward urging force by the spring 28 and the inward pressing force at the time when the sheet is pressed are distributed by the spring seat 29 and the receiving seat 30.

Therefore, it is possible to manufacture the sheet guide section 11 having high durability and a simple and compact structure without unnecessarily increasing the size and thickness of the inner rail 16 and the outer rail 14.

Figure 14:
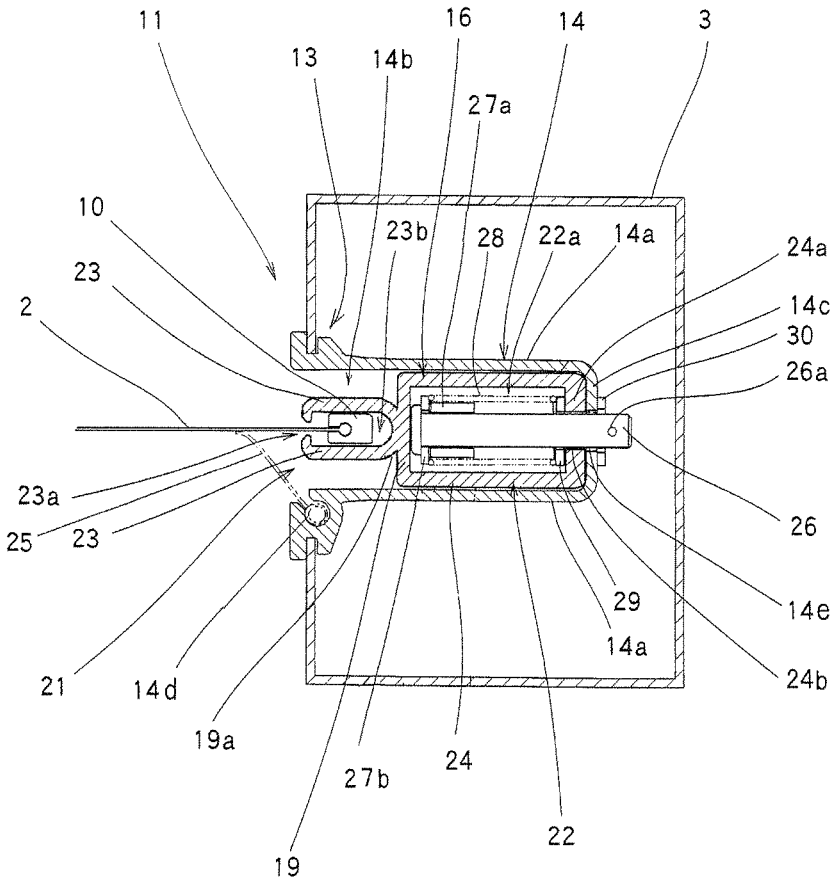
FIG. 14 is a sectional view showing a configuration of another embodiment of the support post and the sheet guide section.

FIG. 14 is a horizontal sectional view of a sheet guide, showing another embodiment of the inner rail 16, and corresponds to the sectional view of FIG. 5 showing the above described embodiment. Similarly, FIG. 15 and FIG. 16 respectively correspond to FIG. 6 and FIG. 7 showing the above described embodiment.

Figure 7:
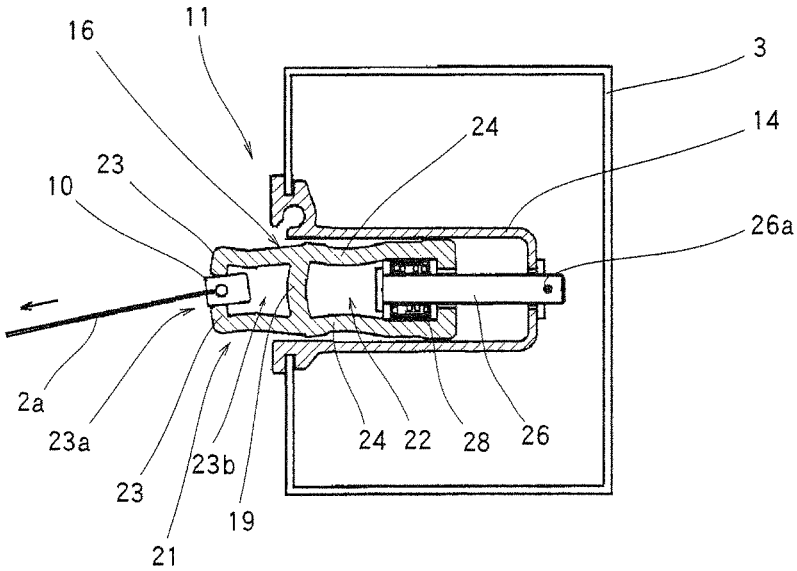
FIG. 7 is a sectional view showing a state where the guide projection shown in FIG. 5 is about to come off from the engagement guide.

The configuration of the sheet guide according to the present embodiment is the same as the configuration of the sheet guide shown in FIG. 5 except that the cross sectional shape of the engagement guide 21 of the inner rail 16 is different from the cross sectional shape the engagement guide 21 of the inner rail 16 shown in FIG. 5 to FIG. 7, and that the direction of the outer rail 14 is reversed in the vertical direction (thereby, the mounting position of the seal member 25 and the position of the mounting groove 14*d* are reversed in the front and rear direction).

Therefore, here, the mechanism portions and operation portions which are common to those of the sheet guide shown in FIG. 5 are denoted by the same reference numerals and characters, and the detailed description thereof will be omitted.

In the sheet guide shown in FIG. 14, the front and rear guide walls 23 and 23 of the engagement guide 21 are formed to face in parallel with each other, and the rectangular guide projection 10 which is accommodated and locked in the guide groove 23*b* is configured so as to be slidable in the guide groove 23*b* in the left and right direction.

Further, the guide wall 23 has a uniform thickness as a whole, and the internal bottom surface of the guide groove 23*b* is formed in a semi-circular arc shape curved toward the outer side. Further, a constricted section 19*a* formed by a groove having a V-shaped cross section formed by crossing the circular arc of the guide wall 23 and the plane of the partition wall 19 is formed at the vertical outside boundary portion between the base portion of each of the guide walls 23 and the intermediate wall 19. This means that the guide walls 23 and 23 are connected by a central portion of the intermediate wall 19, which portion has a narrow front and rear width.

Figure 15:
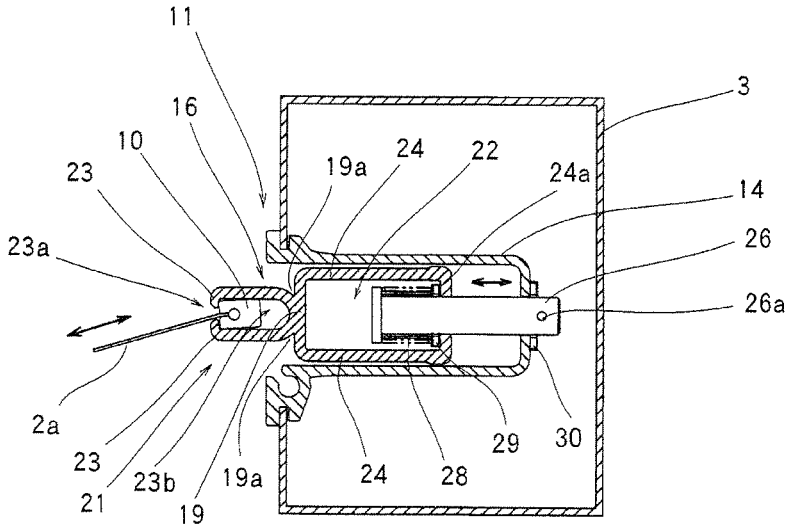
FIG. 15 is a sectional view showing a state where the inner rail shown in FIG. 14 is moved to the inner side.

In the above described structure of the engagement guide 21, when the sheet 2 is pulled inward by a wind pressure, or the like, the guide projection 10 is slid inward in the guide groove 23*b*, so as to be locked by the sheet groove 23*a* as shown in FIG. 15. On the other hand, when no tensile force is applied to the sheet 2, the guide projection 10 is slid outward in the guide groove 23*b*, so as to return to the return position.

Figure 16:
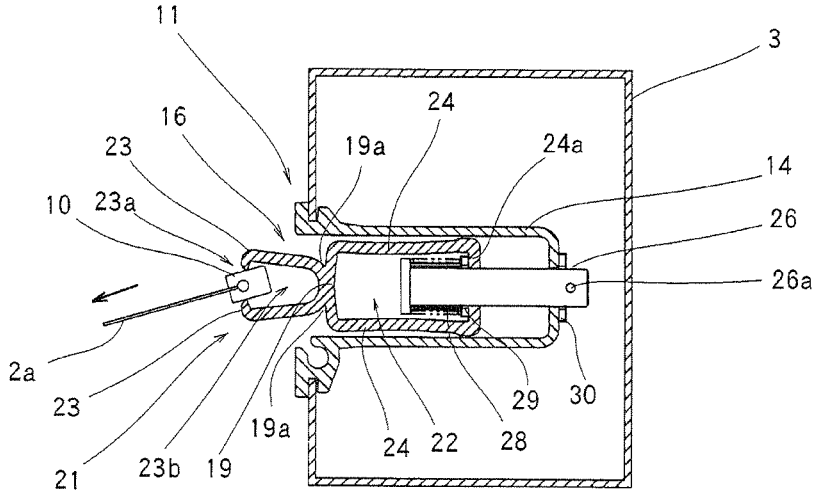
FIG. 16 is a sectional view showing a state where the guide projection shown in FIG. 14 is about to come off from the engagement guide.

Further, when a stronger force is applied to the sheet 2 in the front or rear direction, the guide projection 10 forcibly widens the space between the guide walls 23 and 23 in the front and rear direction due the tensile force of the sheet 2, so as to come off from the engagement guide as shown in FIG. 16. At this time, due to the effect of both the front and rear constricted sections 19*a*, the guide walls 23 and 23 make the intermediate wall 19 itself resiliently deflected inward and make the side walls 24 and 24 resiliently deflected toward the inside of the hollow section 22*a*. Further, when the sheet 2 is strongly pulled to the central direction of the gate, the constricted section 19*a* also acts to forcibly widen the sheet groove 23*a* while resiliently stretching the guide walls 23 and 23 in the left and right direction.

In this way, when a strong pulling force is applied to the sheet 2 in the central direction of the gate, both the front and rear constricted sections 19*a* of the inner rail 16 make the inner rail 16 as a whole flexibly constructed and resiliently deformed so that the deformation and damage due to the over load can be prevented and the sheet 2 is smoothly guided. Further, this structure is also applied to the sheet return guide 17, and hence the returning operation of the detached sheet to the engagement guide 21 is also performed more smoothly.

Figure 17:
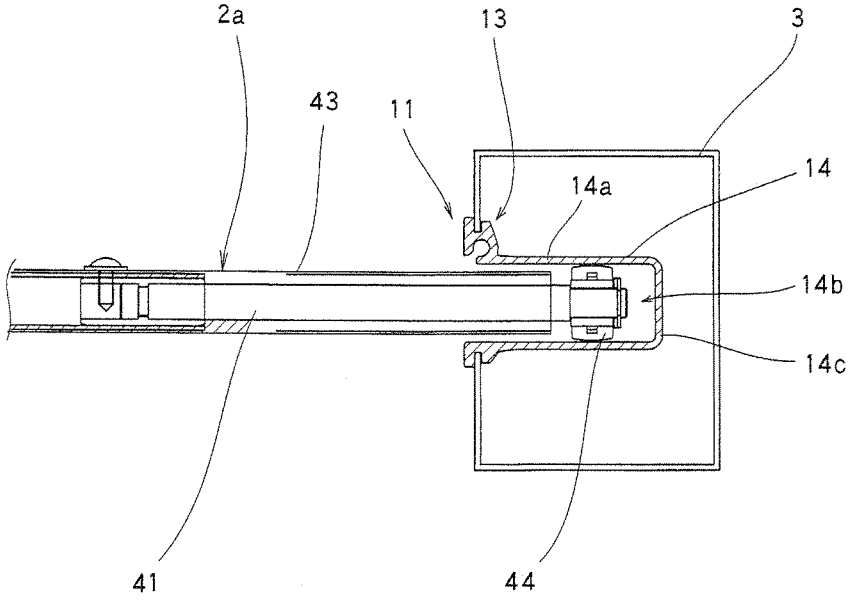
FIG. 17 is a sectional view showing a state where a core of a sheet with the core is inserted into the outer rail from which the inner rail shown in FIG. 5 to FIG. 7 is removed.
Figure 18:
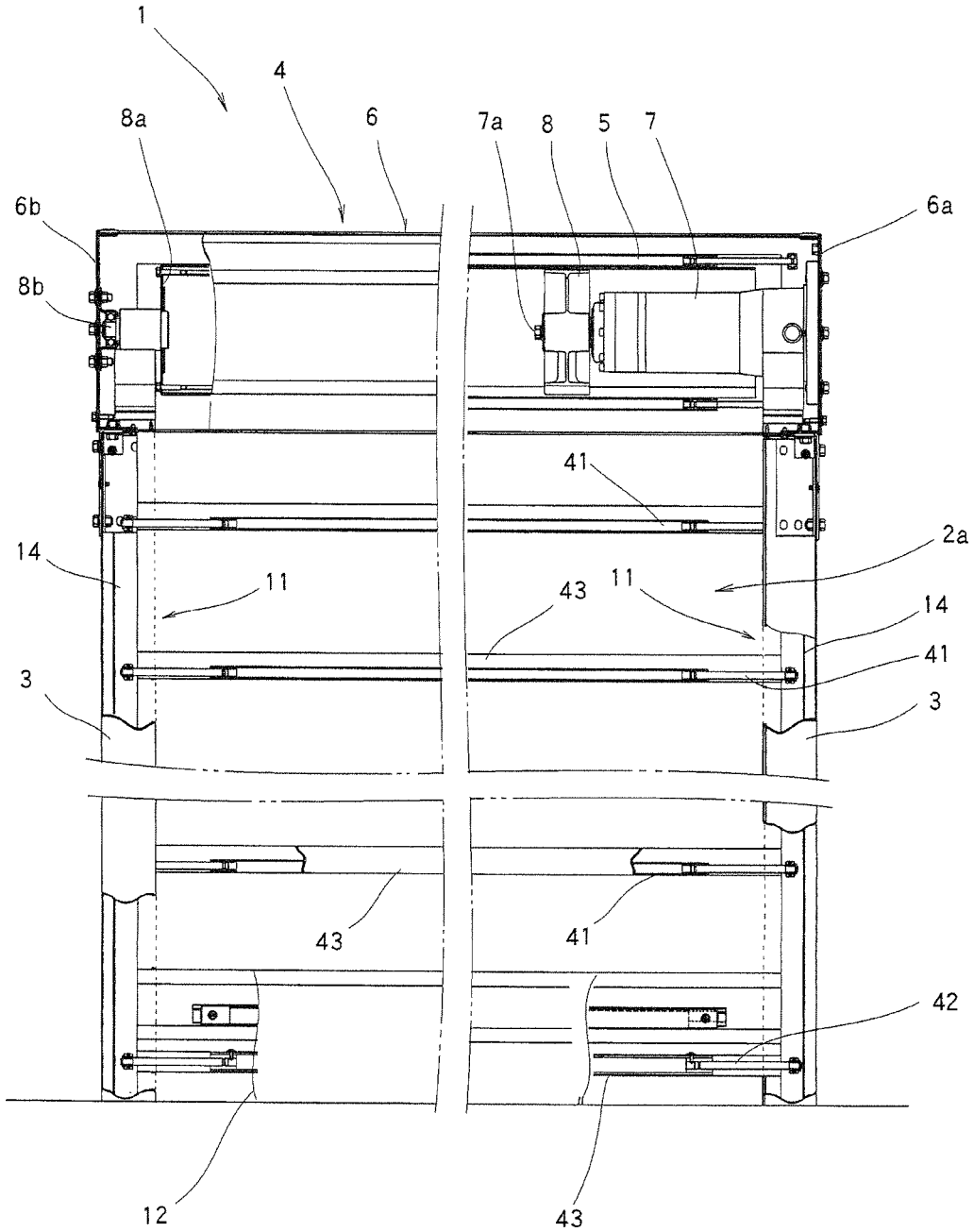
FIG. 18 is a front view, shown partly in section, a sheet shutter having the sheet with the core shown in FIG. 17.

FIG. 17 and FIG. 18 show another use form of the sheet shutter 1. That is, FIG. 17 is a horizontal sectional view of a core portion, showing an example in which, for example, when the sheet shutter 1 of the above described embodiment is already installed, a sheet 2*a* with the core is used in place of the sheet 2. FIG. 18 is a front view of the entire configuration of the sheet shutter 1 using the sheet 2*a* with the core. With the sheet guide according to the present invention, the sheet shutter 1 is configured such that the inner rail 16 and the sheet return guide 17 can be easily removed from the outer rail 14. Therefore, when both ends of a conventional core 41 of the sheet 2*a* with the core 41 are respectively inserted into the left and right outer rails 14 from which the inner rail 16 and the sheet return guide 17 are removed, the core 41 can be guided and slid in the outer rail 14 in the vertical direction, so as to open and close the sheet 2*a*.

That is, in this case, first, the stops 26*a* are removed so as to release the fixation between the mounting pins 26 and the outer rail 14, and each of the mounting pins 26 are extracted through each of the mounting holes 14*e*. Then, both the inner rail 16 and the sheet return guide 17 are removed from the outer rail 14. Further, in place of the sheet 2 with the guide projection 10, the sheet 2*a* with the core is attached to the sheet drum 5 so as to be wound around the sheet drum 5. Also, both ends of the plurality of cores 41 attached to the sheet 2*a* at a predetermined interval and both ends of a core 42 attached to the side of the grounding section 12 are respectively inserted into the rail grooves 14*b* of the left and right outer rails 14.

Thereby, the shutter 1 is set to the standby state for the unwinding operation, in which state the sheet 2*a* is wound to the uppermost lift position of the sheet drum 5. Then, when the unwinding rotation of the sheet drum 5 is performed, the sheet 2*a* is unwound and the lowest core 42 and the subsequent cores 41 are successively slid in the rail groove 14*b* in the lower direction, and thereby the gate can be closed. Further, when the winding operation of the sheet drum 5 is performed, the respective cores 41 are slid in the outer rail 14 in the upper direction, so that the sheet 2*a* can be wound and lifted. Note that, similarly to the conventional cores, each of the cores 41 and 42 shown in the figure is inserted into and supported by each of mounting bags 43 respectively formed at the core mounting positions of the sheet 2, and is inserted into the rail groove 14*b* via a roller 44 attached to the shaft end of each of the cores.

Therefore, with a simple and inexpensive configuration, the sheet guide provided in the support post 3 and configured to enable the inner rail 16 to be detachably attached in the outer rail 14 can be changed, by removing the inner rail 16, into a configuration to accommodate the sheet-stretching lateral core 41 in the outer rail 14, without exchanging the support post 3 with the other support post. Further, contrary to this use form, the sheet shutter 1 provided with the sheet 2*a* with the core can be changed to the sheet 2 with the guide projection 10. In this case, the exchange of the sheet can be performed only by such a simple work that the sheet 2*a* is exchanged by the sheet 2, and the inner rail 16 and the sheet return guide 17 are added to the outer rail 14.

What is claimed is:

1. A sheet guide of a sheet shutter including:

a sheet case configured to laterally and rotatably journal therein a sheet drum for winding and unwinding a sheet in the vertical direction;

support posts respectively provided to support both the left and right ends of the sheet case; and a sheet guide section fixed to each of the support posts so as to guide the up and down movement of the sheet, wherein the sheet guide section is configured by an outer rail having a U-shaped cross section which is provided with a pair of front and rear side walls and is opened toward the inner side in the left and right direction of a horizontal cross section of the left and right support posts, and an inner rail accommodated and detachably attached in the outer rail along the inner surface of the outer rail, wherein the inner rail is provided with an engagement guide facing the inner side in the left and right direction and configured to vertically slidably and engagingly accommodate each of guide projections respectively attached to both ends of the sheet, wherein the inner rail is attached in the outer rail by a plurality of mounting pins, wherein a coil spring for resiliently pulling the guide projection to the outside direction is mounted on the outside of each mounting pin, wherein the inner rail is hollow, has front and rear side walls, and wherein the coil spring with the mounting pin inserted therein is accommodated in an inner locking section which is the space formed between the front and rear side walls of the inner rail.

2. The sheet guide of the sheet shutter according to claim 1, wherein the inner rail is fitted in the outer rail so as to be slidable in the left and right direction of the sheet and is supported by being resiliently pulled toward the outside in the left and right direction.

3. The sheet guide of the sheet shutter according to claim 1, wherein an intermediate wall for partitioning the inside and the outside of the inner rail in the left and right direction is formed in an intermediate portion of the inner rail, wherein the engagement guide is formed at a position inside the intermediate wall, and wherein the side walls directed in the left and right direction are respectively provided at outside positions of both the front and rear ends of the intermediate wall.

4. The sheet guide of the sheet shutter according to one of claim 1 to claim 3, wherein a sheet return guide for, when the sheet is lifted, guiding and returning each end of the sheet disengaged from the engagement guide of the inner rail into the engagement guide is detachably connected to the upper end portion of the inner rail.

5. The sheet guide of the sheet shutter according to claim 1, wherein a plurality of mounting holes are provided at a predetermined interval in the vertical direction in a bottom wall which is formed between the outside ends of the front and rear side walls of the outer rail, wherein a vertically directed pin groove is formed between hook sections which are respectively formed at the outside ends of the front and rear side walls of the inner rail so as to face each other, and wherein the inner rail is attached to the outer rail by respectively inserting the mounting pins each having a head section at the inner side end thereof into the mounting holes and the pin groove.

6. The sheet guide of the sheet shutter according to claim 5, wherein a vertical band-shaped spring seat which resiliently presses the front and rear hook sections of the inner rail to the bottom wall of the outer rail by the coil spring so as to enable the inner rail to slide in the vertical direction and is supported in at least two vertical positions by the mounting pins inserted through the spring seat is provided between the inner surface of the bottom wall and the coil spring at each of a plurality of positions arranged in the vertical direction, and wherein a guide surface warped to the side opposite to the inner surface of the bottom wall of the outer rail is formed at the lower end of each of the spring seats whereby the inner rail can be inserted between the spring seat and the bottom wall from the lower side under the guidance of the guide surface at the time when the inner rail is attached to the outer rail.

7. The sheet guide of the sheet shutter according to claim 4, wherein the sheet return guide which has a connection piece configured to be connected to the upper end of the inner rail and is provided with the engagement guide and the inner locking section so as to have the same cross sectional shape as the cross sectional shape of the inner rail is connected to the upper end of the inner rail by the connection piece, and wherein a return groove configured to guide and return, into the engagement guide of the inner rail, the guide projection of the sheet being lifted in the disengaged state from the engagement guide is provided at the lower end side of the sheet return guide.

8. The sheet guide of the sheet shutter according to claim 7, wherein a lubrication member configured to be exposed in the engagement guide to supply lubricant to the guide projection being lifted and lowered in the engagement guide is provided at the upper end side of the sheet return guide.

9. The sheet guide of the sheet shutter according to claim 7, wherein the same pin groove as the pin groove of the inner rail is provided at the outside end of the sheet return guide, wherein the mounting pin, the coil spring and the spring seat are accommodated in the sheet return guide, and wherein the inner rail is attached so as to he resiliently press-contacted with the side of the outer rail by the mounting pin whereby the upper end of the inner rail can be inserted between the spring seat and the inner surface of the bottom wall of the outer rail from the lower side at the time when the inner rail is attached to the outer rail.

* * * * *